US008249438B2

(12) United States Patent
Lo

(10) Patent No.: US 8,249,438 B2
(45) Date of Patent: Aug. 21, 2012

(54) MULTI-SETTING CIRCUITS FOR THE PORTABLE DRYER

(75) Inventor: Teh-Liang Lo, Taipei County (TW)

(73) Assignee: Tek Maker Corporation, Taipei (TW)

( * ) Notice: Subject to any disclaimer, the term of this patent is extended or adjusted under 35 U.S.C. 154(b) by 994 days.

(21) Appl. No.: 12/242,945

(22) Filed: Oct. 1, 2008

(65) Prior Publication Data

US 2010/0080539 A1 Apr. 1, 2010

(51) Int. Cl.
*F24H 1/10* (2006.01)

(52) U.S. Cl. ..... 392/485; 34/97; 219/480

(58) Field of Classification Search ..... None
See application file for complete search history.

(56) References Cited

U.S. PATENT DOCUMENTS 4,003,388 A * 1/1977 Nopanen ..... 219/222
4,198,557 A * 4/1980 Crowley ..... 392/384
4,327,278 A * 4/1982 Tomaro ..... 392/379
4,711,988 A * 12/1987 Thaler et al. ..... 392/379
4,791,519 A * 12/1988 Madsen ..... 361/42
6,285,828 B1 * 9/2001 Cafaro ..... 392/385
6,327,428 B1 * 12/2001 Lo et al. ..... 392/385
6,397,003 B1 * 5/2002 Cheng ..... 392/385
6,408,131 B2 * 6/2002 Lo et al. ..... 392/385
6,718,651 B2 * 4/2004 Perez et al. ..... 34/96
6,873,792 B2 3/2005 Lo
6,901,214 B2 5/2005 Lo

* cited by examiner

*Primary Examiner* — Thor Campbell
(74) *Attorney, Agent, or Firm* — Winston Hsu; Scott Margo

(57) ABSTRACT

A dryer circuit includes a main circuit and a connection controller. The dryer circuit includes a power unit, a first and second heating units, a first and a second switches, a motor having a fan installed, a resistor, a first diode, and a second diode. The first and the second heating units are coupled to ground respectively through the first and the second switches. The resistor is coupled between the first heating unit and the motor. The first diode is coupled between the second heating unit and the motor. The second diode is coupled between the first heating unit and the motor and in series with the resistor. The connection controller controls the first and the second switches on or off for adjusting the power supplied to the motor, and the first and the second heating units at the same time.

10 Claims, 35 Drawing Sheets

Mode 1

| Mode 1 | $R_{HG1}$ | $R_{HG2}$ | $R_1$ | $R_M$ | Sum |
|---|---|---|---|---|---|
| $V_B$=20V | 2Ω | 2Ω | 3.2Ω | 8Ω | |
| V | 20 | 0 | 5.7 | 14.3 | |
| I | 10 | 0 | 1.8 | 1.8 | |
| W | 200 | 0 | 10.4 | 25.9 | 236.3 |

FIG. 3

Mode 2

| Mode 2 | $R_{HG1}$ | $R_{HG2}$ | $R_1$ | $R_M$ | Sum |
|---|---|---|---|---|---|
| $V_B$=20V | 2Ω | 2Ω | 3.2Ω | 8Ω | |
| V | 0 | 20 | 0 | 20 | |
| I | 0 | 10 | 0 | 2.5 | |
| W | 0 | 200 | 0 | 50 | 250 |

FIG. 5

Mode 3

| Mode 3 | $R_{HG1}$ | $R_{HG2}$ | $R_1$ | $R_M$ | Sum |
|---|---|---|---|---|---|
| $V_B$=20V | 2Ω | 2Ω | 3.2Ω | 8Ω | |
| V | 20 | 20 | 0 | 20 | |
| I | 10 | 10 | 0 | 2.5 | |
| W | 200 | 200 | 0 | 50 | 450 |

FIG. 7

Mode 1

Mode 2

Mode 3

Mode 0

Mode 1

Mode 3

Mode 1

Mode 3

Mode 0

Mode 0

Mode 0

Mode 0

Mode 0

MULTI-SETTING CIRCUITS FOR THE PORTABLE DRYER

BACKGROUND OF THE INVENTION

1. Field of the Invention

The present invention relates to a portable dryer, and more particularly, to a multi-setting portable dryer and related circuit design.

2. Description of the Prior Art

The conventional dryer is operable only after establishing connection with an AC power plug through a power cord. The use of the dryer is then limited by the length of the cord to the area that can be reached by the cord from the AC power receptacle. Therefore, it is very inconvenient for traveling purposes, in particular, when traveling in countries where the AC power specifications, such as voltages, cycles, and receptacles vary from one to another. Different converters and transformers are needed if the user wants to use a conventional dryer. Furthermore, since the conventional AC-powered dryers are powered by AC currents with sinusoidal amplitudes, most use a diode to control the generation of heat. When the switch is shifted to a low heat setting, the one-way conduction property of the diode filters out a half cycle of the AC current that passes through the heating filament. When the switch is shifted to a high heat setting, the current to the heating filament does not go through the diode so that heat can be generated at full output. At the same time, in order to provide a DC current to the motor, an additional bridge rectifier has to be employed to supply the needed DC power.

SUMMARY OF THE INVENTION

The present invention provides a dryer circuit. The dryer circuit comprises a main circuit and a connection controller. The main circuit comprises a power unit, a first heating unit, a second heating unit, a fan motor, a diode, and a resistor. The power unit comprises a first end for providing a first predetermined voltage, and a second end for providing a second predetermined voltage. The first heating unit comprises a first end coupled to the first end of the power unit, and a second end. The second heating unit comprises a first end coupled to the first end of the power unit, and a second end. The fan motor comprises a first end coupled to the first end of the power unit, and a second end. The diode is coupled between the second end of the second heating unit and the second end of the fan motor. The resistor is coupled between the second of the first heating unit and the second end of the fan motor. The connection controller is coupled to the second end of the first heating unit, the second end of the second heating unit, and the second end of the power unit for switching coupling of the second end of the first heating unit to the second end of the power unit and switching coupling of the second end of the second heating unit to the second end of the power unit.

The present invention further provides a dryer circuit. The dryer circuit comprises a main circuit, and a connection controller. The main circuit comprises a power unit, a first heating unit, a second heating unit, a fan motor, a diode, and a resistor. The power unit comprises a first end for providing a first predetermined voltage, and a second end for providing a second predetermined voltage. The first heating unit comprises a first end, and a second end coupled to the second end of the power unit. The second heating unit comprises a first end coupled to the first end of the first heating unit, and a second end. The fan motor comprises a first end coupled to the first end of the first heating unit, and a second end. The diode is coupled between the second end of the second heating unit and the second end of the fan motor. The resistor is coupled between the second of the first heating unit and the second end of the fan motor. The connection controller is coupled to the power unit, the first heating unit, and the second heating unit, for switching coupling between the first heating unit, the power unit, and the second heating unit.

The present invention further provides a dryer circuit. The dryer circuit comprises a main circuit, and a connection controller. The main circuit comprises a power unit, a first heating unit, a second heating unit, a fan motor, a diode, and a resistor. The power unit comprises a first end for providing a first predetermined voltage, and a second end for providing a second predetermined voltage. The first heating unit comprises a first end coupled to the first end of the power unit, and a second end. The second heating unit comprises a first end coupled to the first end of the first heating unit, and a second end. The fan motor comprises a first end coupled to the first end of the first heating unit, and a second end. The diode is coupled between the second end of the second heating unit and the second end of the fan motor. The resistor is coupled between the second of the first heating unit and the second end of the fan motor. The connection controller is coupled to the power unit, the first heating unit, and the second heating unit, for switching coupling between the first heating unit, the power unit, and the second heating unit.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3 shows the calculation of the power consumptions on the components in the dryer circuit in the mode 1.

FIG. 5 shows the calculation of the power consumptions on the components in the dryer circuit in the mode 2.

FIG. 7 shows the calculation of the power consumptions on the components in the dryer circuit in the mode 3.

DETAILED DESCRIPTION

The present invention utilizes a portable electrical power source (e.g., battery). Therefore, the portable dryer circuit of the present invention does not need to connect to an AC receptacle. Furthermore, the present invention provides innovative circuit designs to control the power consumed by the motor and the power consumed by the heating units at the same time for generating airflow at the desired heat output.

Figure 1:
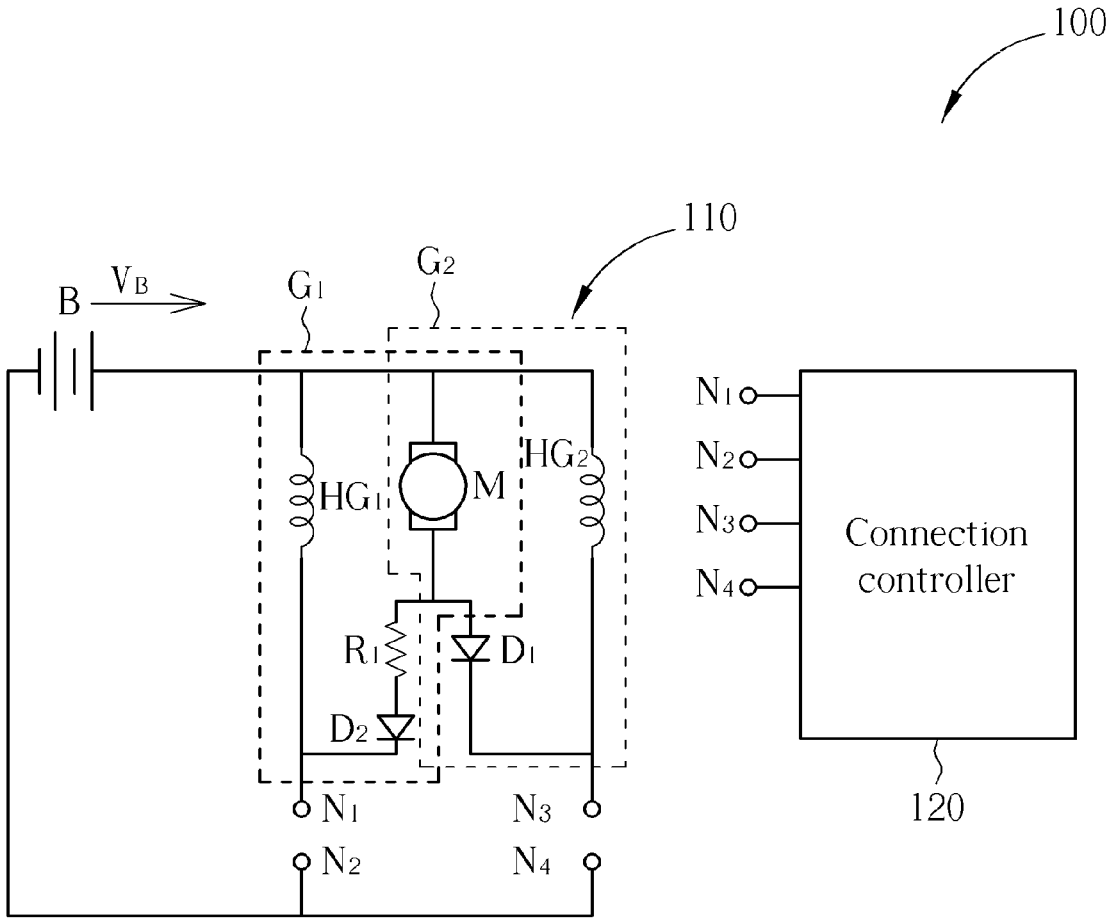
FIG. 1 is a diagram illustrating the dryer circuit according to a first embodiment of the present invention.

Please refer to FIG. 1. FIG. 1 is a diagram illustrating the dryer circuit 100 according to a first embodiment of the present invention. As shown in FIG. 1, the dryer circuit 100 comprises a main circuit 110 and a connection controller 120. The main circuit 110 comprises a power unit B, a motor M (including a fan), two diodes $D_1$ and $D_2$, two heating units $HG_1$ and $HG_2$, a resistor $R_1$, and four nodes $N_1$, $N_2$, $N_3$, and $N_4$. However, the node $N_2$ is equivalent to the node $N_4$ electrically. The power unit B comprises a positive end for providing a voltage $V_B$ (20 volts), and a negative end for serving as a ground end (0 volt). The heating units $HG_1$ and $HG_2$ generate heat according to power consumed by the heating units $HG_1$ and $HG_2$, respectively. The motor M (including a fan) generates airflow with a volume according to the power consumed by the motor M.

Between the positive end of the power unit B and node $N_1$, the heating unit $HG_1$, the motor M, the diode $D_2$, and the resistor $R_1$ form a circuit group $G_1$. In the circuit group $G_1$, the motor M is coupled to the diode $D_2$ and the resistor $R_1$, which the diode $D_2$ and the resistor $R_1$ are coupled in series, and the motor is further coupled to the heating unit $HG_1$ in parallel.

Between the positive end of the power unit B and node $N_3$, the heating unit $HG_2$, the motor M, and the diode $D_1$, form a circuit group $G_2$. In the circuit group $G_2$, the motor M and the diode $D_1$ are coupled in series, and the motor M is further coupled to the heating unit $HG_2$ in parallel.

The connection controller 120 controls the connection between the nodes $N_1$ and $N_2$ and the connection between the nodes $N_3$ and $N_4$, respectively. Therefore, by controlling the current to flow through the circuit groups $G_1$, the circuit group $G_2$, or both the circuit groups $G_1$ and $G_2$, different modes of the dryer circuit 100 are achieved.

The following are to define four operating modes, mode 0, 1, 2, and 3 of the present invention. In mode 0, the connection controller 120 disconnects both the nodes $N_1$ from $N_2$ and the nodes $N_3$ from $N_4$. Therefore, no current flows through the motor M, the heating units $HG_1$ and $HG_2$. In mode 1, the connection controller 120 connects the node $N_1$ to the node $N_2$, which means current only flows through the circuit group $G_1$. In mode 2, the connection controller 120 connects the node $N_3$ to the node $N_4$, which means current only flows through the circuit group $G_2$. In mode 3, the connection controller 120 connects the node $N_1$ to the node $N_2$, and connects the node $N_3$ to the node $N_4$, which means current flows through both the circuit group $G_1$ and circuit group $G_2$.

Figure 2:
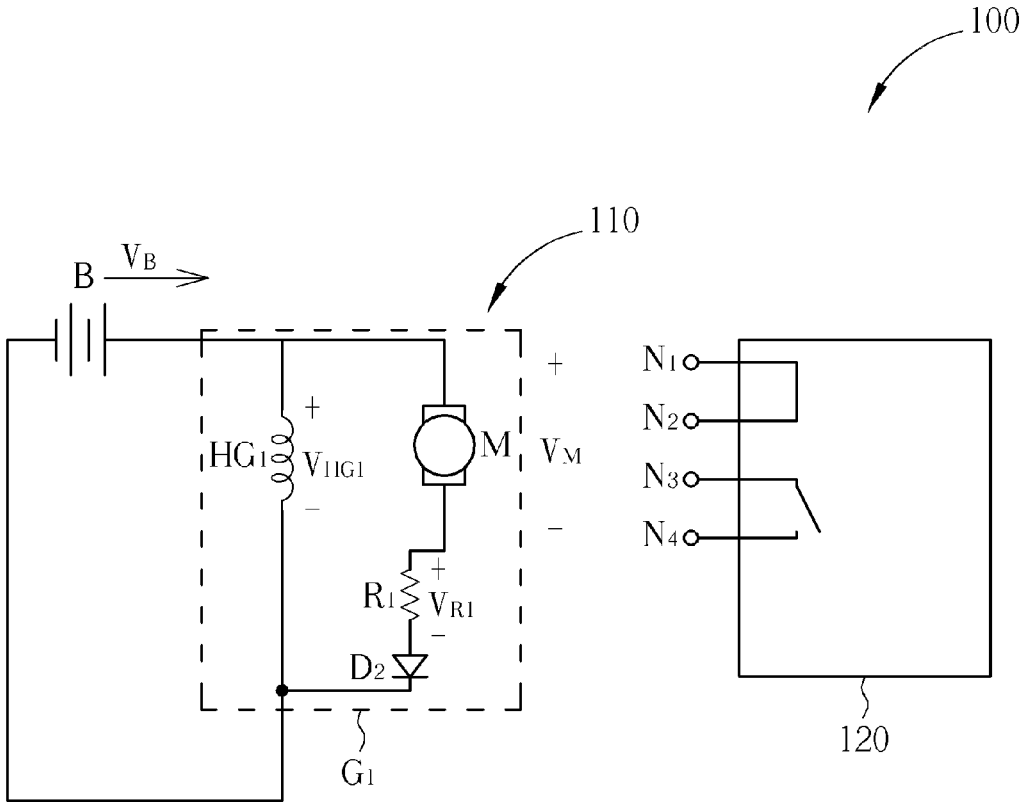
FIG. 2 is a diagram illustrating the dryer circuit of FIG. 1 operating in the mode 1.

Please refer to FIG. 2. FIG. 2 is a diagram illustrating the dryer circuit 100 operating in mode 1. As shown in FIG. 2, the connection controller 120 connects the node $N_1$ to the node $N_2$, but disconnects the node $N_3$ from the node $N_4$. The diode $D_1$, instead of filtering a half cycle of the AC current as utilized in a traditional hair dryer, blocks the DC current flowing through the heating unit $HG_2$ in mode 1 operation. Therefore, the electric power provided by the power unit B passes through the circuit group $G_1$, and the voltage on the heating unit $HG_1$ equals to the voltage $V_B$. Neglecting the small voltage drops over the diode $D_2$, the voltage $V_B$ is shared by the resistor $R_1$ and the motor M according to their impedances respectively.

In mode 1, the power consumed respectively by the heating unit $HG_1$ and the motor M are calculated by the following equations:

$$P_{HG1}=V_B^2/(R_{HG1}) \quad (1)$$

$$V_M=V_B\times[R_M/(R_M+R_1)] \quad (2)$$

$$P_M=V_M^2/R_M=V_B^2\times R_M/(R_M+R_1)^2 \quad (3)$$

wherein $V_M$ represents the voltage on the motor M, $P_{HG1}$ and $P_M$ represent the power consumed by the heating unit $HG_1$ and the motor M respectively, and $R_{HG1}$, $R_1$ and $R_M$ represent the impedance of the heating unit $HG_1$, resistor $R_1$ and the motor M respectively.

Please refer to FIG. 3. FIG. 3 shows the calculation of the power consumptions on the components in the main circuit 110 in mode 1. As shown in FIG. 3, the power to the motor M is 25.9 Watt, and the total power of the main circuit 110 is 236.3 Watt.

Figure 4:
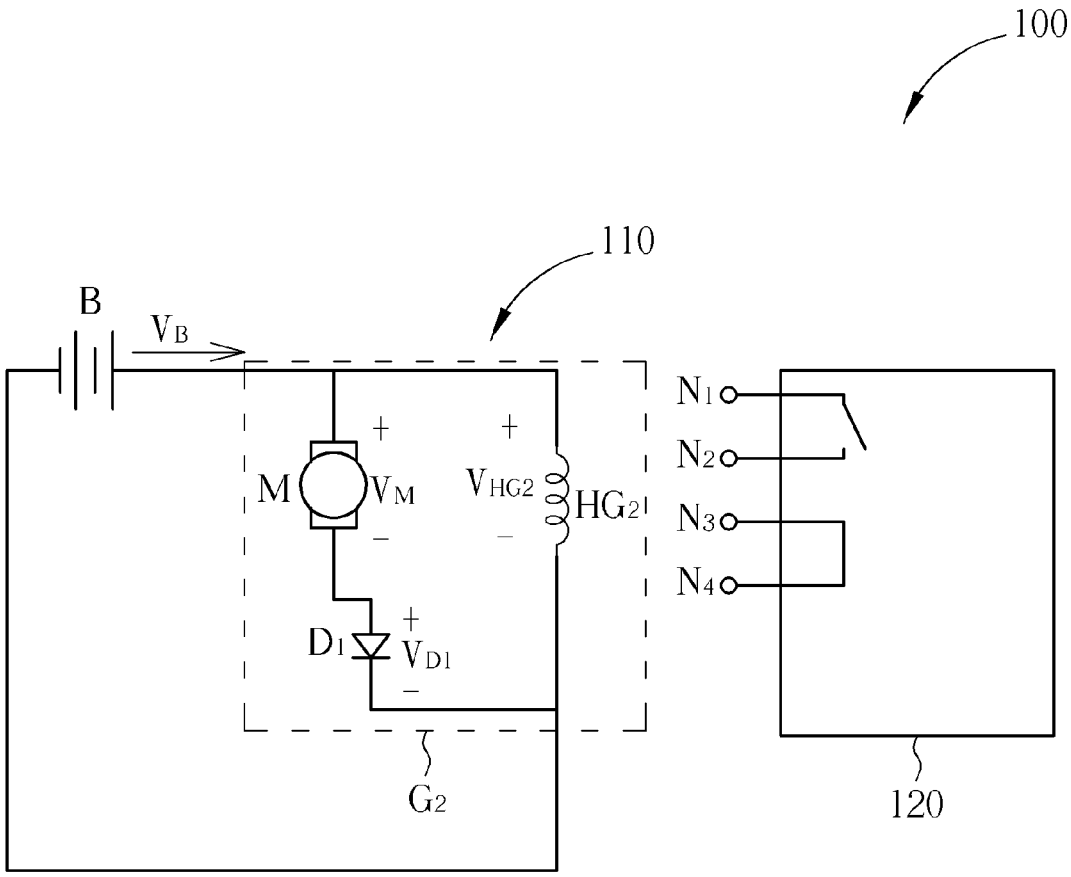
FIG. 4 is a diagram illustrating the dryer circuit of FIG.1 operating in the mode 2.

Please refer to FIG. 4. FIG. 4 is a diagram illustrating the dryer circuit 100 operating in mode 2. As shown in FIG. 4, the connection controller 120 connects the node $N_3$ to the node $N_4$, but disconnects the node $N_1$ from the node $N_2$. The diode $D_2$ blocks the DC current flowing through the heating unit $HG_1$ in mode 2 operation. Therefore, the electric power provided by the power unit B passes through the circuit group $G_2$, and the voltage on the heating unit $HG_2$ equals to the voltage $V_B$. Neglecting the small voltage drops over the diode $D_1$, the voltage on the motor M equals to the voltage $V_B$.

In mode 2, the power consumed respectively by the heating unit $HG_2$ and the motor M are calculated by the following equations:

$$P_{HG2}=V_B^2/(R_{HG2}) \quad (4)$$

$$P_M=V_B^2/R_M \quad (5)$$

wherein the $P_{HG2}$ represents the power consumed by the heat unit $HG_2$, and $R_{HG2}$ represents the impedance of the heat unit $HG_2$.

Please refer to FIG. 5. FIG. 5 shows the calculation of the power consumptions on the components in the main circuit 110 in mode 2. As shown in FIG. 5, the power to the motor M is 50 Watt and the total power of the main circuit 110 is 250 Watt. The total power of the main circuit 110 has slight difference between in mode 2 and mode 1. However, the power to the motor M in mode 2 is almost twice as much as that in mode 1.

Figure 6:
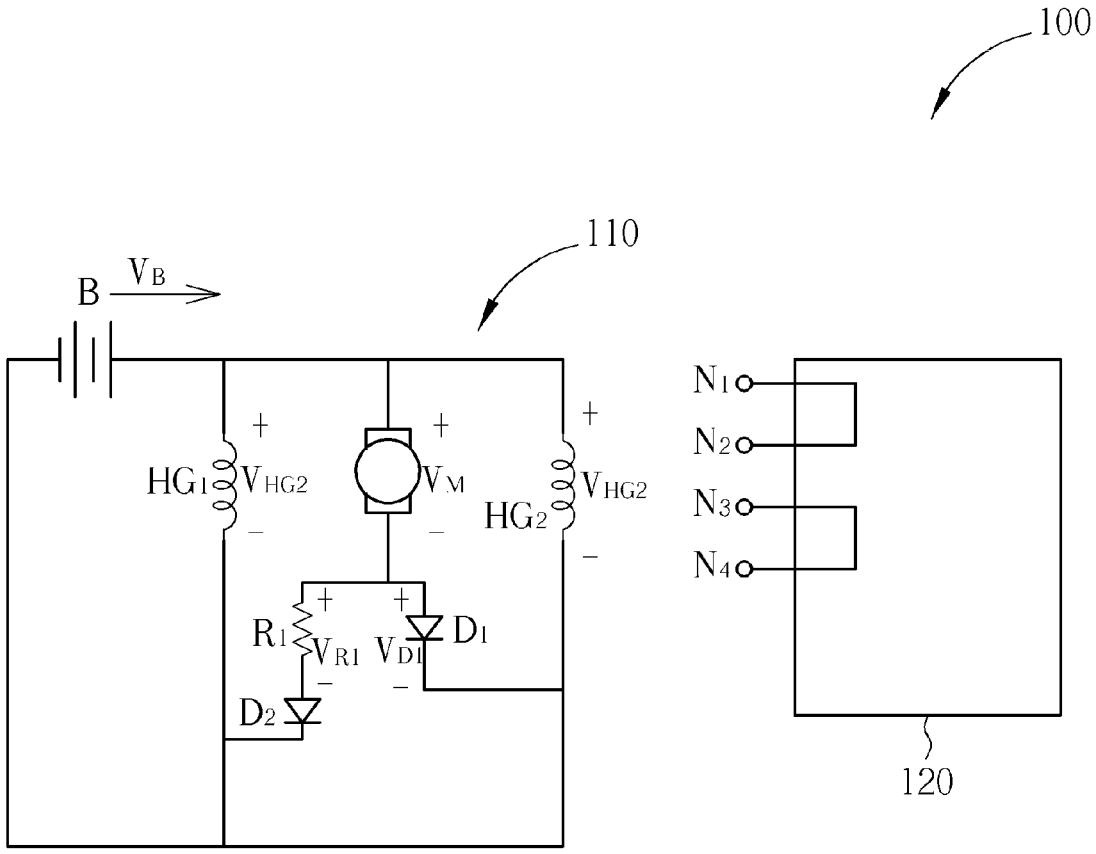
FIG. 6 is a diagram illustrating the dryer circuit of FIG. 1 operating in the mode 3.

Please refer to FIG. 6. FIG. 6 is a diagram illustrating the dryer circuit 100 operating in mode 3. As shown in FIG. 6, the connection controller 120 connects the node $N_1$ to the node $N_2$, and connects the node $N_3$ to the node $N_4$. Therefore, the electric power provided by the power unit B passes through both the circuit group $G_1$ and circuit group $G_2$, and the voltage on the heating unit $HG_1$ equals to the voltage $V_B$ and the voltage on the heating unit $HG_2$ equals to the voltage $V_B$. Because the resistor $R_1$ is disposed in the circuit group $G_1$, the current flowing through the resistor $R_1$ and the diode $D_2$ can be ignored in mode 3. Neglecting the small voltage drops over the diode $D_1$, the voltage on the motor M equals to the voltage $V_B$.

In mode 3, the power consumed respectively by the heating units $HG_1$ and $HG_2$ and the motor M are calculated by the following equations:

$$P_{HG1}=V_B^2/(R_{HG1}) \quad (6)$$

$$P_{HG2}=V_B^2/(R_{HG2}) \quad (7)$$

$$P_M=V_M^2/R_M=V_B^2/R_M \quad (8)$$

wherein the $P_{HG1}$ and $P_{HG2}$ respectively represent the power consumed by the heat units $HG_1$ and $HG_2$, $R_{HG1}$ and $R_{HG2}$ respectively represent the impedances of the heat units $HG_1$ and $HG_2$, $P_M$ represents the power consumed by the motor M, and $R_M$ represents the impedance of the motor M.

Please refer to FIG. 7. FIG. 7 shows the calculation of the power consumptions on the components in the main circuit 110 in mode 3. As shown in FIG. 7, the power to the motor M is 50 Watt, and the total power of the main circuit 110 is 450 Watt. Both the power to the motor M and the total power of the main circuit 110 in mode 3 are nearly twice as much as those in mode 1.

Figure 8:
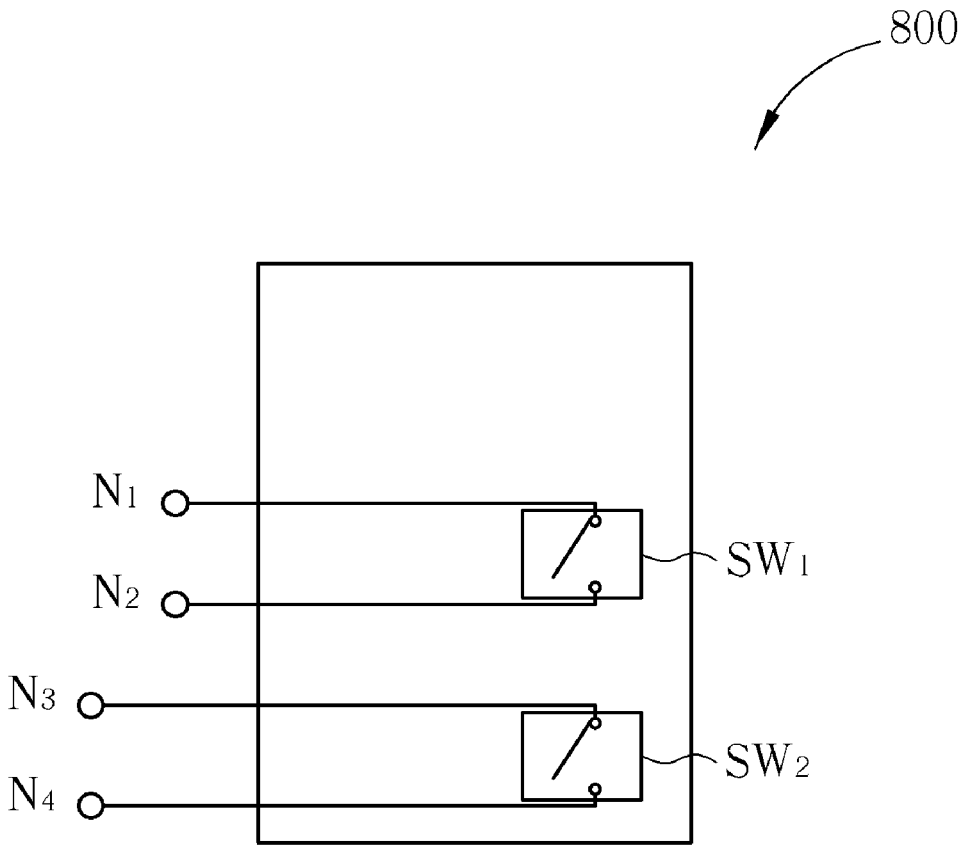
FIG. 8 is a diagram illustrating a first connection controller of the first embodiment of the present invention.

Please refer to FIG. 8. FIG. 8 is a diagram illustrating a first connection controller 800 of the first embodiment of the present invention. As shown in FIG. 8, the connection controller 800 comprises two switches $SW_1$ and $SW_2$ respectively for controlling the connection between nodes $N_1$ and $N_2$ and the connection between nodes $N_3$ and $N_4$. The switches $SW_1$ and $SW_2$ are respectively controlled to achieve the operation of the dryer circuit 100 in modes 0, 1, 2, and 3. The switches $SW_1$ and $SW_2$ can be mechanical switches.

Figure 9:
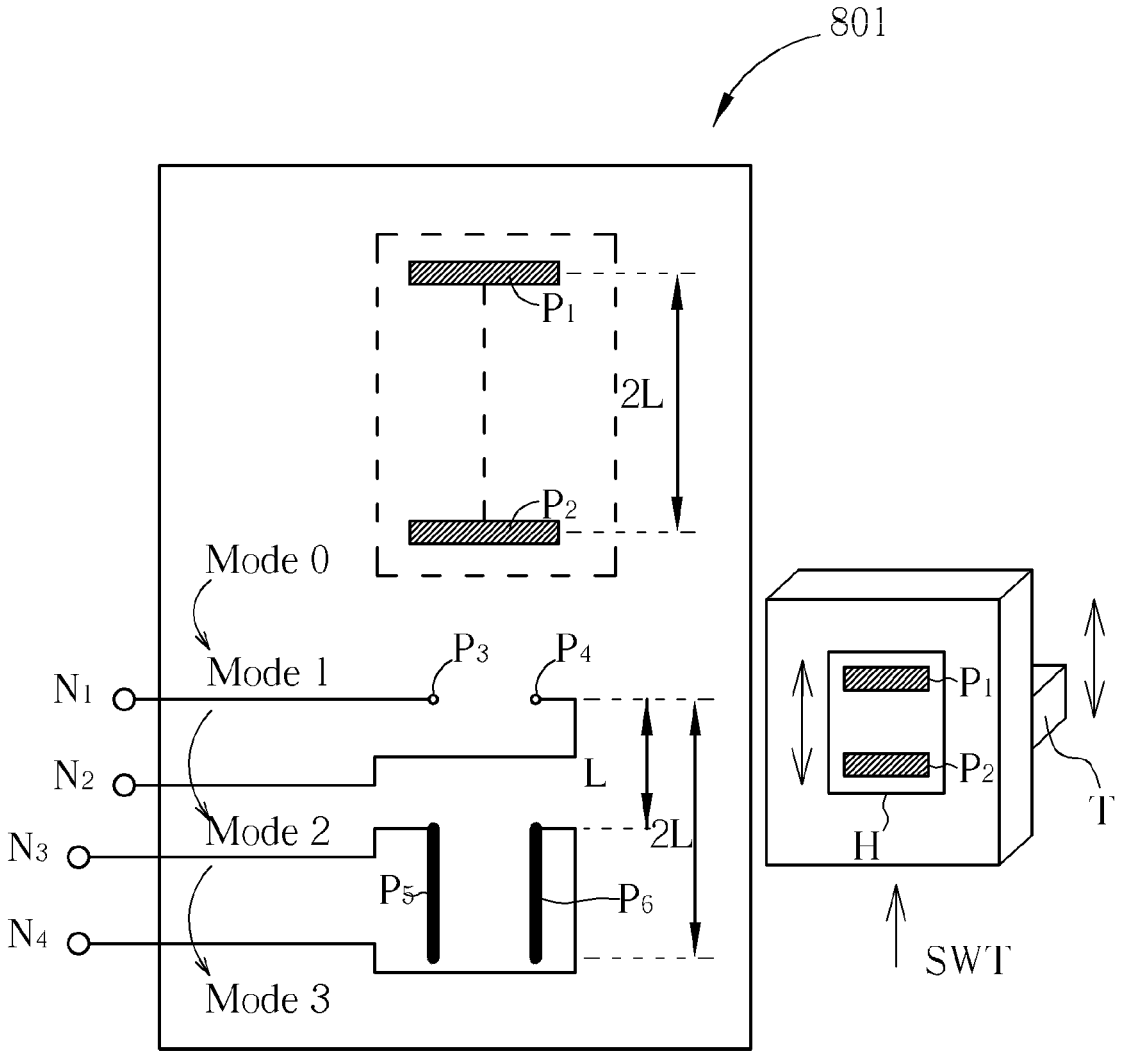
FIG. 9 is a diagram illustrating a second connection controller of the first embodiment of the present invention.

Please refer to FIG. 9. FIG. 9 is a diagram illustrating the connection controller 801 based on the connection controller 800 and utilizing a slide switch SWT of the present invention. As shown in FIG. 9, the slide switch SWT comprises a base H, a slide button T, and two conducting pads $P_1$ and $P_2$. The slide switch SWT is disposed for controlling the connection between the nodes $N_1$ and $N_2$ and the connection between the nodes $N_3$ and $N_4$. The conducting pads $P_3$ and $P_4$ are disposed for the nodes $N_1$ and $N_2$ and are both shaped as dots. The conducting pads $P_5$ and $P_6$ are disposed for the nodes $N_3$ and $N_4$ and are shaped as lines. By moving the slide button T of the slide switch SWT to different positions, the dryer circuit 100 can operate in modes 0, 1, 2, and 3.

In FIG. 9, by default setting, the connection controller 801 achieves mode 0 for the dryer circuit 100 by disposing the slide button T in a position so that both the conducting pads $P_1$ and $P_2$ do not contact with the pads $P_3$, $P_4$, $P_5$, and $P_6$.

Figure 10:
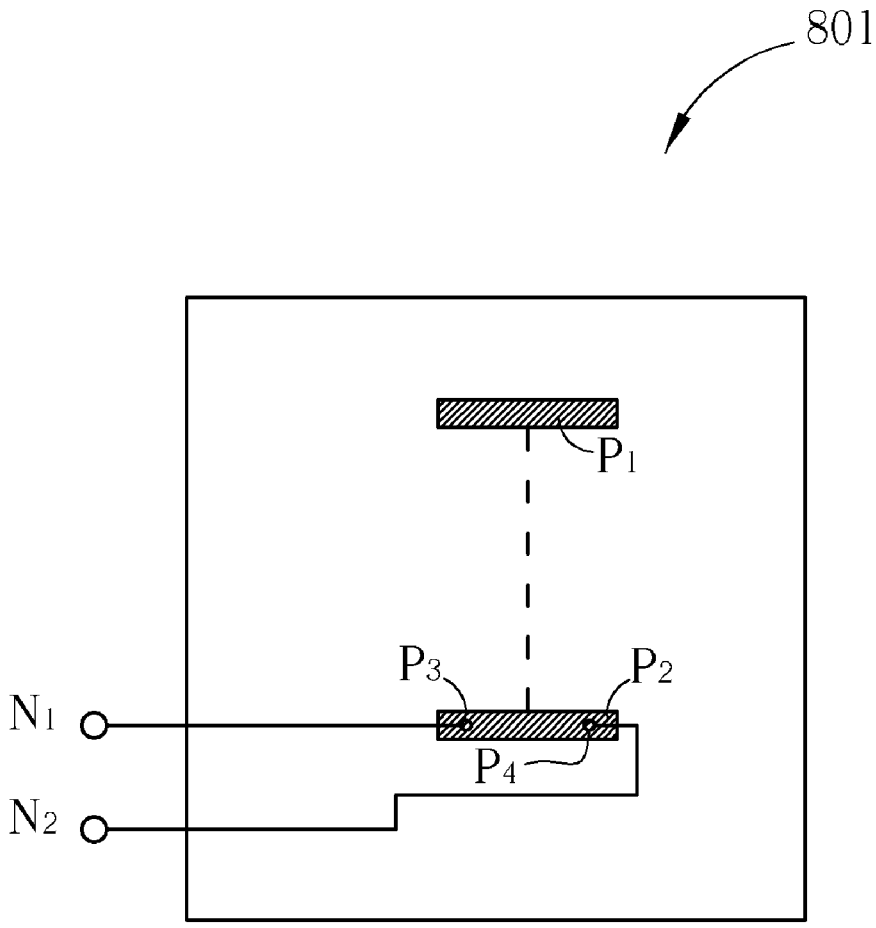
FIG. 10 is a diagram illustrating the connection controller of FIG. 9 in the mode 1.

Please refer to FIG. 10. FIG. 10 is a diagram illustrating the connection controller 801 in mode 1. As shown in FIG. 10, the slide button T moves downward so that the conducting pad $P_2$ contacts with the conducting pads $P_3$ and $P_4$ in order to establish the connection between the nodes $N_1$ and $N_2$. Therefore, the nodes $N_1$ and $N_2$ are short-circuited by the conducting pad $P_2$, and consequently the dryer circuit 100 operates in mode 1.

Figure 11:
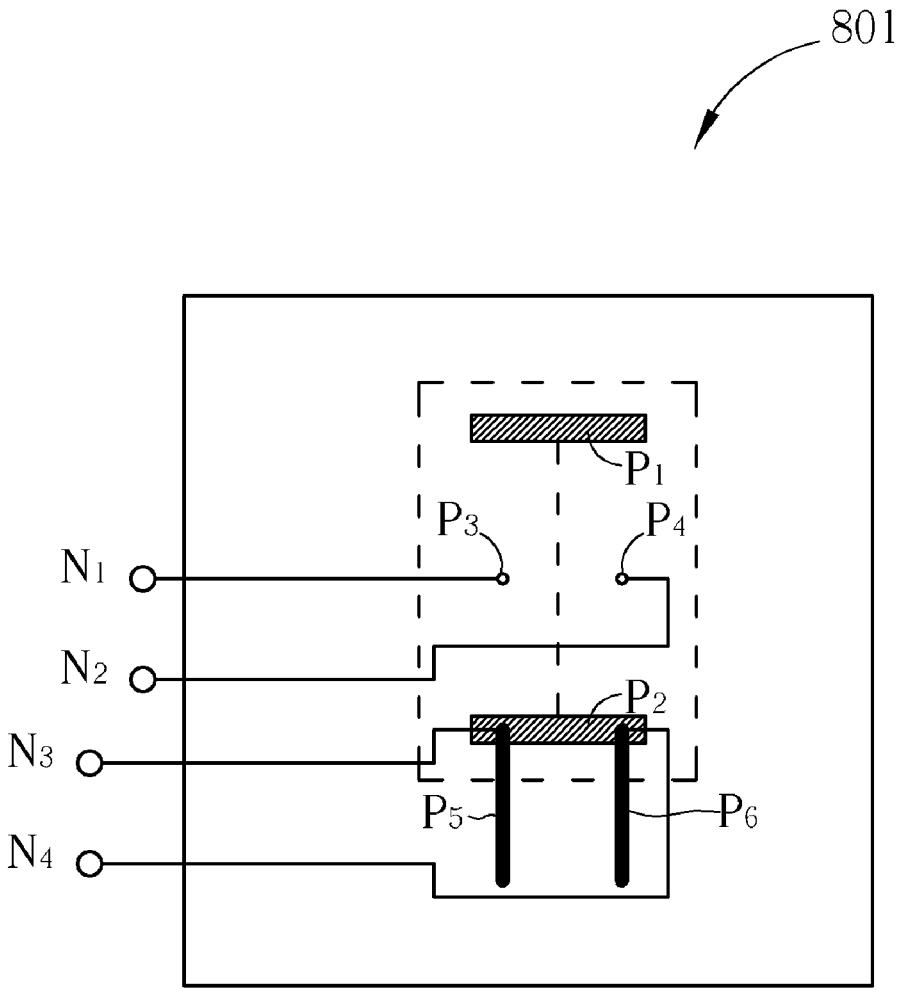
FIG. 11 is a diagram illustrating the connection controller of FIG. 9 in the mode 2.

Please refer to FIG. 11. FIG. 11 is a diagram illustrating the connection controller 801 in mode 2. As shown in FIG. 11, the slide button T moves further downward so that the conducting pad $P_2$ shifts away from pads $P_3$ and $P_4$ and contacts with the conducting pads $P_5$ and $P_6$ to establish the connection between the nodes $N_3$ and $N_4$. Therefore, the nodes $N_3$ and $N_4$ are short-circuited by the conducting pad $P_2$, and consequently the dryer circuit 100 operates in mode 2.

Figure 12:
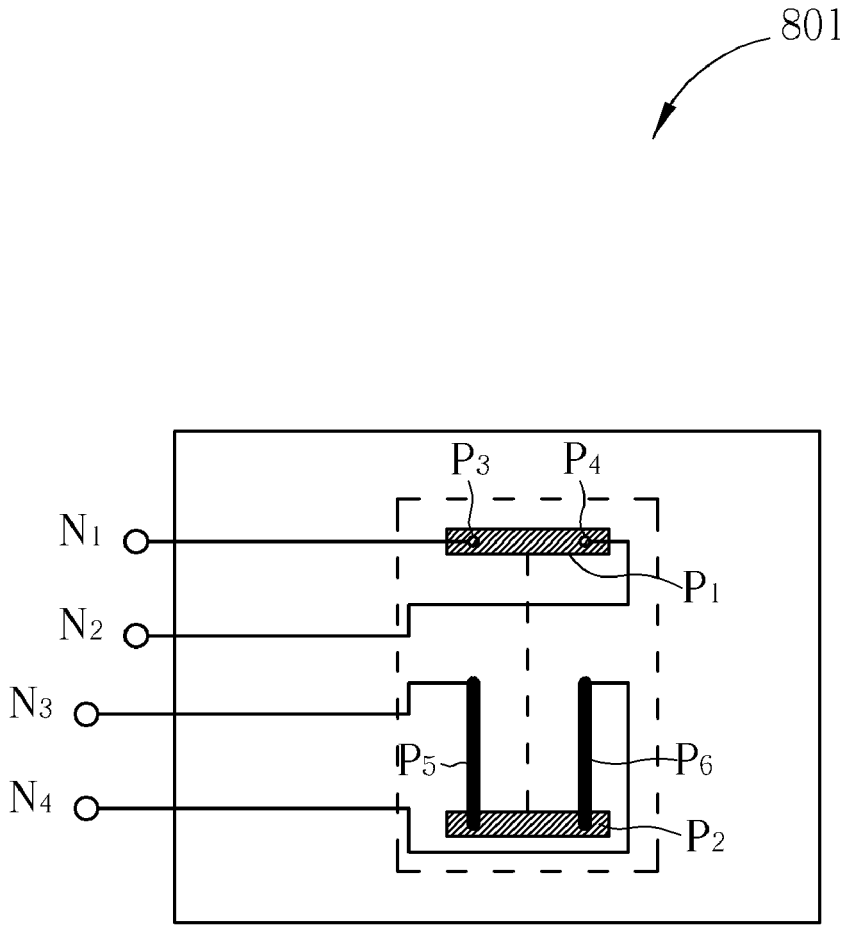
FIG. 12 is a diagram illustrating the connection controller of FIG. 9 in the mode 3.

Please refer to FIG. 12. FIG. 12 is a diagram illustrating the connection controller 801 in mode 3. As shown in FIG. 12, the slide button T moves further downward so that the conducting pad $P_2$ still contacts with the conducting pads $P_5$ and $P_6$ in order to establish the connection between the nodes $N_3$ and $N_4$, and the conducting pad $P_1$ contacts with the conducting pads $P_3$ and $P_4$ in order to establish the connection between the nodes $N_1$ and $N_2$, Therefore, the nodes $N_1$ and $N_2$ are short-circuited by the conducting pad $P_1$, the nodes $N_3$ and $N_4$ are short-circuited by the conducting pad $P_2$, and consequently the dryer circuit 100 operates in mode 3.

Figure 13:
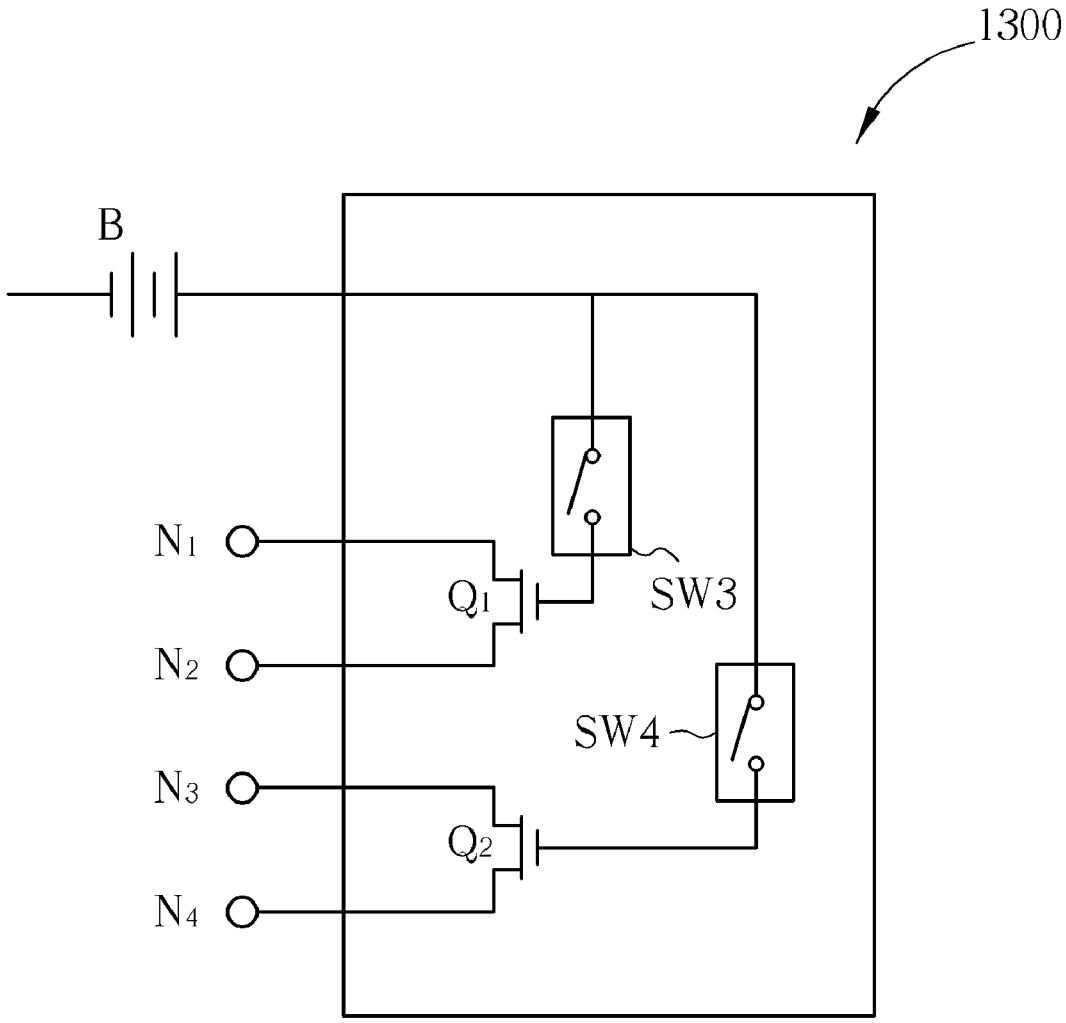
FIG. 13 is a diagram illustrating a third connection controller of the first embodiment of the present invention.

Please refer to FIG. 13. FIG. 13 is a diagram illustrating another connection controller 1300 of the first embodiment of the present invention. As shown in FIG. 13, the connection controller 1300 comprises a transistor $Q_1$ controlled by a switch $SW_3$ for the connection between the nodes $N_1$ and $N_2$, and a transistor $Q_2$ controlled by a switch $SW_4$ for the connection between the nodes $N_3$ and $N_4$. The transistor $Q_1$ connects the node $N_1$ to node $N_2$ when the switch $SW_3$ is short-circuited to the power unit B for transmitting the voltage $V_B$ so that the control end of the transistor $Q_1$ receives the voltage $V_B$ from the power unit B. The transistor $Q_1$ disconnects the node $N_1$ from the node $N_2$ when the switch $SW_3$ is open (no voltage is received on the control end of the transistor $Q_1$). The transistor $Q_2$ connects the node $N_3$ to the node $N_4$ when the switch $SW_4$ is short-circuited to the power unit B for transmitting the voltage $V_B$ so that the control end of the transistor $Q_2$ receives the voltage $V_B$ from the power unit B. The transistor $Q_2$ disconnects the node $N_3$ from the node $N_4$ when the switch $SW_4$ is open (no voltage is received on the control end of the transistor $Q_2$). Additionally, the voltage transmitted to the control ends of the transistors $Q_1$ and $Q_2$ for controlling the transistors $Q_1$ and $Q_2$ can be positive or negative, depending on the transistors being forward-biased or reverse-biased. The switches $SW_3$ and $SW_4$ are respectively controlled to achieve the operation of the dryer circuit 100 in modes 0, 1, 2, and 3.

Figure 14:
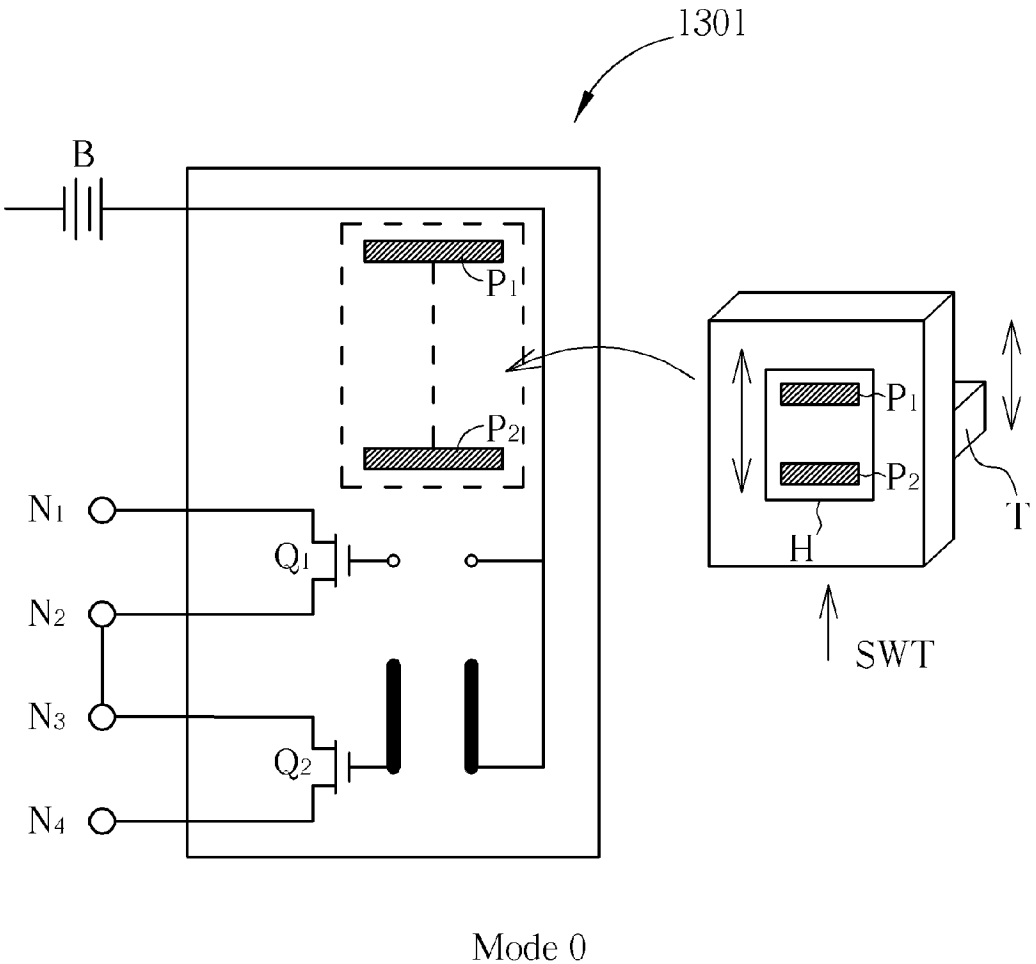
FIG. 14 is a diagram illustrating a fourth connection controller of the first embodiment of the present invention.

Please refer to FIG. 14. FIG. 14 is a diagram illustrating the connection controller 1301 based on the connection controller 1300 and utilizing a slide switch SWT of the present invention. As shown in FIG. 14, the slide switch SWT is disposed for controlling the connection between the nodes $N_1$ and $N_2$ and the connection between the nodes $N_3$ and $N_4$. The dryer circuit 100 operates in modes 0, 1, 2, and 3 according to the movement of the slide button T of the slide switch SWT as described from FIG. 9 to FIG. 12 and the related description is omitted.

Figure 15:
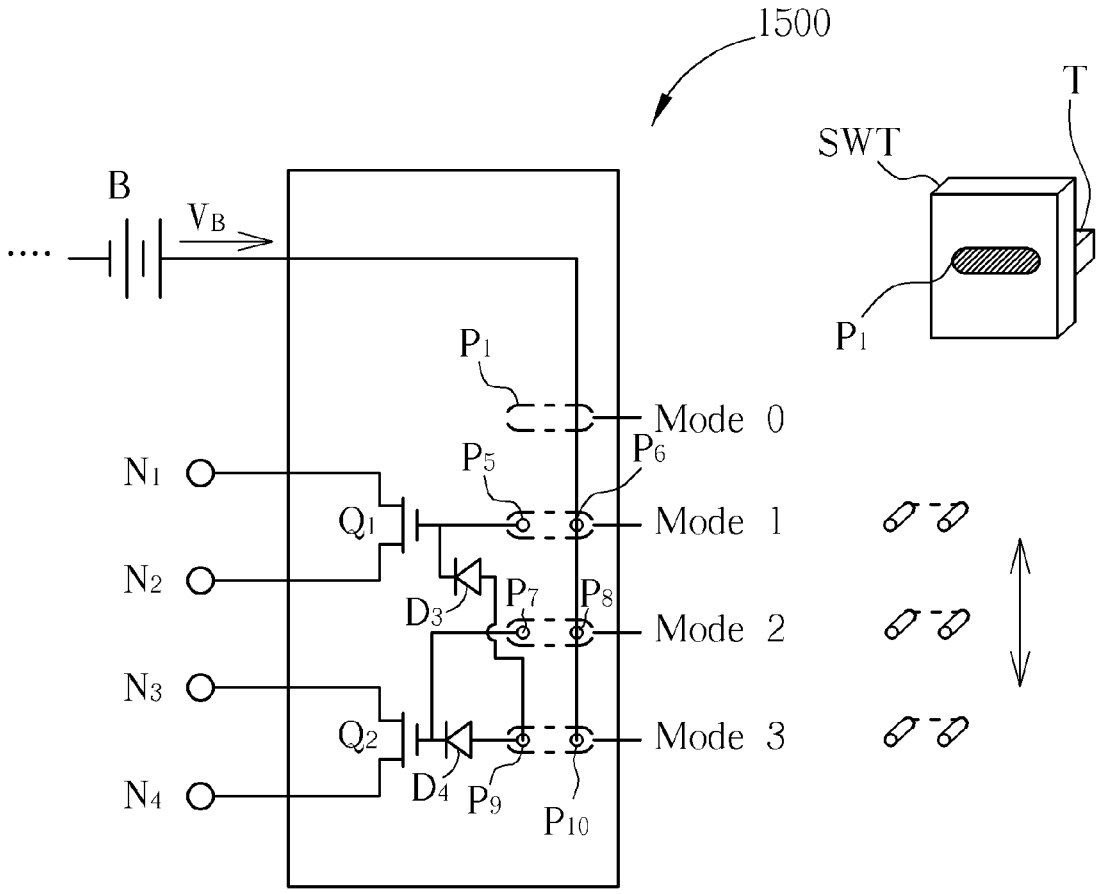
FIG. 15 is a diagram illustrating a fifth connection controller of the first embodiment of the present invention.

Please refer to FIG. 15. FIG. 15 is a diagram illustrating another connection controller 1500 of the first embodiment of the present invention. As shown in FIG. 15, the connection controller 1500 comprises two transistors $Q_1$ and $Q_2$ both controlled by a slide switch SWT, three pads $P_6$, $P_8$ and $P_{10}$ connected to the power unit B, a pad $P_5$ connected to the control end of transistor $Q_1$, a pad $P_7$ connected to the control end of transistor $Q_2$, and a pad $P_9$ connected to both the control ends of transistor $Q_1$ and transistor $Q_2$ through the diodes $D_3$ and $D_4$ respectively. The slide switch SWT comprises a base H, a slide button T, and a conducting pad $P_1$.

When the slide button T of the slide switch SWT shifts to the position for mode 1, the pad $P_5$ and the pad $P_6$ are short-circuited by the conducting pad $P_1$, so the control end of the transistor $Q_1$ receives the voltage $V_B$ from the power unit B. Therefore, the transistor $Q_1$ connects the node $N_1$ to the node $N_2$. The diode $D_3$ prevents the transistor $Q_2$ from receiving the voltage $V_B$ from the power unit B when the pad $P_5$ and the pad $P_6$ are short-circuited.

When the slide button T of the slide switch SWT shifts to the position for mode 2, the pad $P_7$ and the pad $P_8$ are short-circuited by the conducting pad $P_1$, so the control end of the transistor $Q_2$ receives the voltage $V_B$ from the power unit B. Therefore, the transistor $Q_2$ connects the node $N_3$ to the node $N_4$. The diode $D_4$ prevents the transistor $Q_1$ from receiving the voltage $V_B$ from the power unit B when the pad $P_7$ and the pad $P_8$ are short-circuited.

When the slide button T of slide switch SWT shifts to the position for mode 3, the pad $P_9$ and the pad $P_{10}$ are short-circuited by the conducting pad $P_1$, so both the control ends of the transistors $Q_1$ and $Q_2$ receive the voltage $V_B$ from the power unit B. Therefore, the transistor $Q_1$ connects the node $N_1$ to the node $N_2$ and the transistor $Q_2$ connects the node $N_3$ to the node $N_4$.

In summary, the dryer circuit 100 can operate in modes 0, 1, 2, and 3 by shifting the slide button T of the slide switch SWT to different positions.

Figure 16:
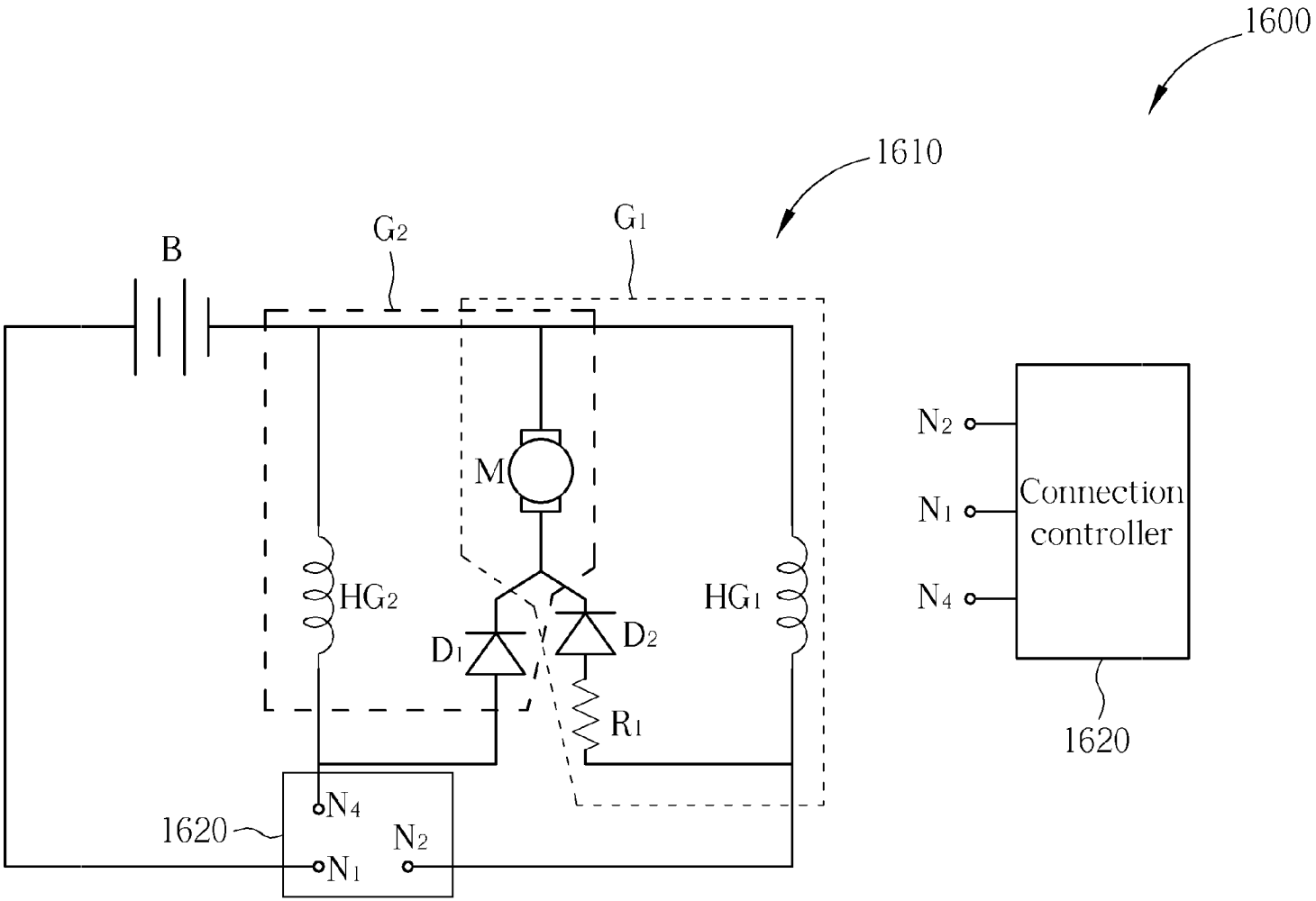
FIG. 16 is a diagram illustrating an equivalent dryer circuit according to the first embodiment of the present invention.

Please refer to FIG. 16. FIG. 16 is a diagram illustrating another dryer circuit 1600 which is electrically equivalent to the dryer circuit 100 of the first embodiment of the present invention. As shown in FIG. 16, the dryer circuit 1600 comprises a main circuit 1610 and a connection controller 1620. The main circuit 1610 comprises a power unit B, a motor M (including a fan), two diodes $D_1$ and $D_2$, two heating units $HG_1$ and $HG_2$, a resistor $R_1$, and three nodes $N_1$, $N_2$, and $N_4$.

Between the node $N_2$ and the negative end of the power unit B, the heating unit $HG_1$, the motor M, the diode $D_2$, and the resistor $R_1$ form a circuit group $G_1$. Between the node $N_4$ and the negative end of the power unit B, the heating unit $HG_2$, the motor M, and the diode $D_1$, form a circuit group $G_2$.

The connection controller 1620 controls the connection between the nodes $N_1$ and $N_2$, and the connection between the nodes $N_1$ and $N_4$, respectively. Therefore, by controlling the current to flow through the circuit groups $G_1$, the circuit group $G_2$, or both the circuit groups $G_1$ and $G_2$, different modes of the dryer circuit 100 are achieved.

Utilizing the connection controller 1620, the main circuit 1610 can operate in mode 0, 1, 2 and 3. Though the dispositions of all components of the dryer circuit 1600 are rearranged and different from those of the dryer circuit 100, the dryer circuit 1600 is electrically equivalent to the dryer circuit 100.

Figure 17:
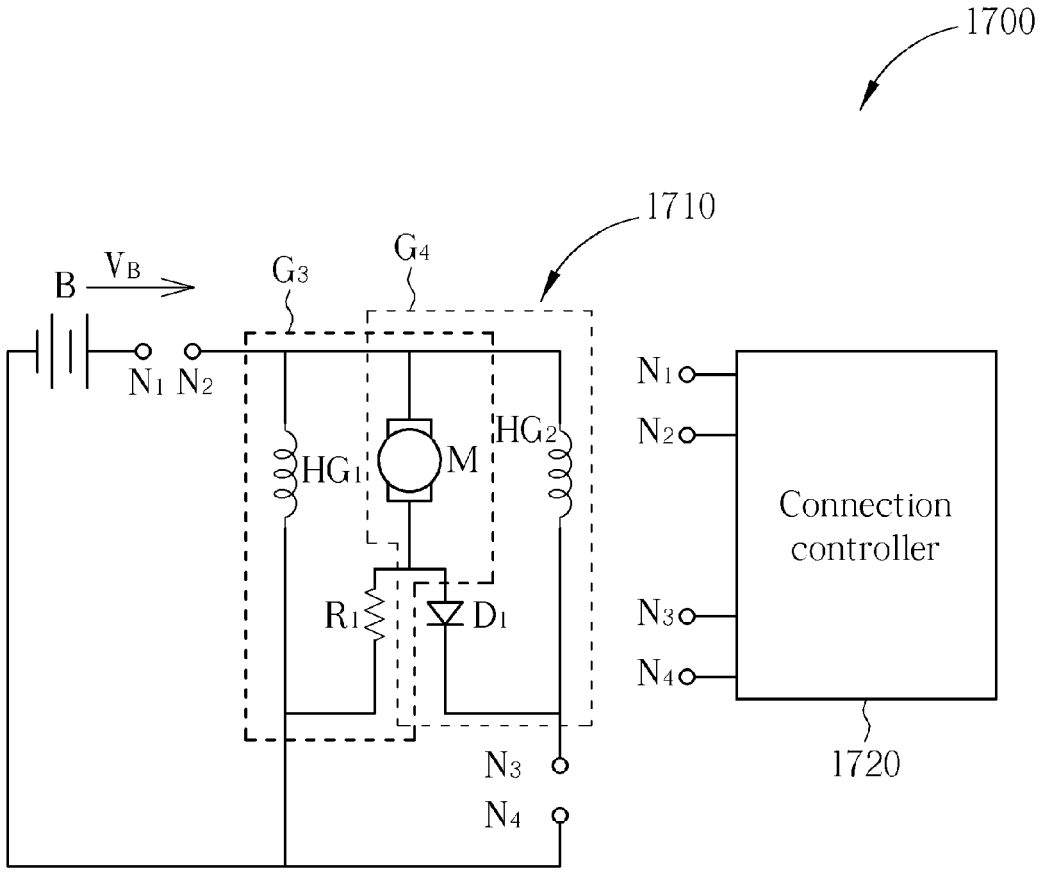
FIG. 17 is a diagram illustrating the dryer circuit according to a second embodiment of the present invention.

Please refer to FIG. 17. FIG. 17 is a diagram illustrating a second embodiment of the present invention. As shown in FIG. 17, the dryer circuit 1700 comprises a main circuit 1710 and a connection controller 1720. The main circuit 1710 comprises a power unit B, a motor M (including a fan), a diode $D_1$, two heating units $HG_1$ and $HG_2$, a resistor $R_1$, and four nodes $N_1$, $N_2$, $N_3$, and $N_4$. The power unit B provides a voltage $V_B$. The heating units $HG_1$ and $HG_2$ generate heat according to power consumed by the heating units $HG_1$ and $HG_2$ respectively. The motor M (including a fan) generates airflow with a volume according to the power consumed by the motor M.

Between the node $N_2$ and the negative end of the power unit B, the heating unit $HG_1$, the motor M, and the resistor $R_1$ form a circuit group $G_3$. In the circuit group $G_3$, the motor M and the resistor $R_1$ are coupled in series, and the motor M and the heating unit $HG_1$ are coupled in parallel.

Between the nodes $N_2$ and $N_3$, the heating unit $HG_2$, the motor M, and the diode $D_1$, form a circuit group $G_4$. In the circuit group $G_4$, the motor M and the diode $D_1$ are coupled in series, and the motor M and the heating unit $HG_2$ are coupled in parallel.

The connection controller 1720 controls the connection between the nodes $N_1$ and $N_2$, and the connection between the nodes $N_3$ and $N_4$, respectively. Therefore, by controlling the current to flow through the circuit groups $G_3$, or both the circuit groups $G_3$ and $G_4$, different modes of the dryer circuit 1700 are achieved.

When the dryer circuit 1700 operates in mode 0, the main circuit 1710 is turned off. The connection controller 1720 disconnects the connection between the nodes $N_1$ and $N_2$. Therefore, no current flows through the motor M, the heating units $HG_1$ and $HG_2$.

However, when the connection controller 1720 disconnects the node $N_1$ from the node $N_2$ and connects the node $N_3$ to the node $N_4$, no current flows through the circuit group $G_4$. Therefore, the dryer circuit 1700 does not operate in mode 2 in the second embodiment of the present invention.

Figure 18:
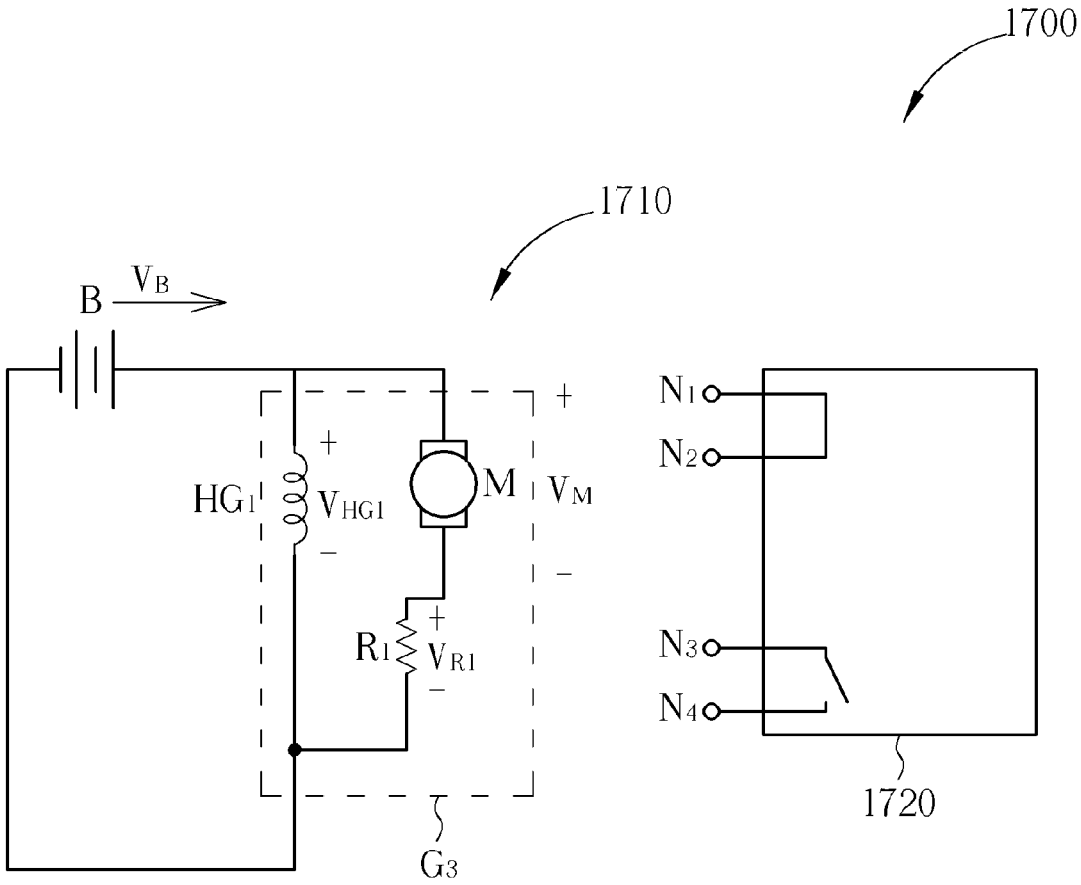
FIG. 18 is a diagram illustrating the dryer circuit of FIG. 17 operating in the mode 1.

Please refer to FIG. 18. FIG. 18 is a diagram illustrating the dryer circuit 1700 operating in mode 1. As shown in FIG. 18, the connection controller 1720 connects the node $N_1$ to the node $N_2$, but disconnects the node $N_3$ from the node $N_4$. The diode $D_1$ blocks the DC current flowing through the heating unit $HG_2$ in mode 1 operation. Therefore, the electric power provided by the power unit B only passes through the circuit group $G_3$, the voltage on the heating unit $HG_1$ equals to the voltage $V_B$, and the resistor $R_1$ and the motor M share the voltage $V_B$ according to their impedances respectively.

In the mode 1, the power consumed respectively by the heating unit $HG_1$ and the motor M are calculated by the following equations:

$$P_{HG1}=V_B^2/(R_{HG1}) \tag{9}$$

$$V_M=V_B\times[R_M/(R_M+R_1)] \tag{10}$$

$$P_M=V_M^2/R_M=V_B^2\times R_M/(R_M+R_1)^2 \tag{11}$$

wherein $V_M$ represents the voltage on the motor M, $P_{HG1}$ and $P_M$ represent the power consumed by the heating unit $HG_1$ and the motor M respectively, and $R_{HG1}$, $R_1$ and $R_M$ represent the impedance of the heating unit $HG_1$, resistor $R_1$ and the motor M respectively. The calculation of the power consumptions on the components in the main circuit 1710 in mode 1 is similar to FIG. 3 and is omitted.

Figure 19:
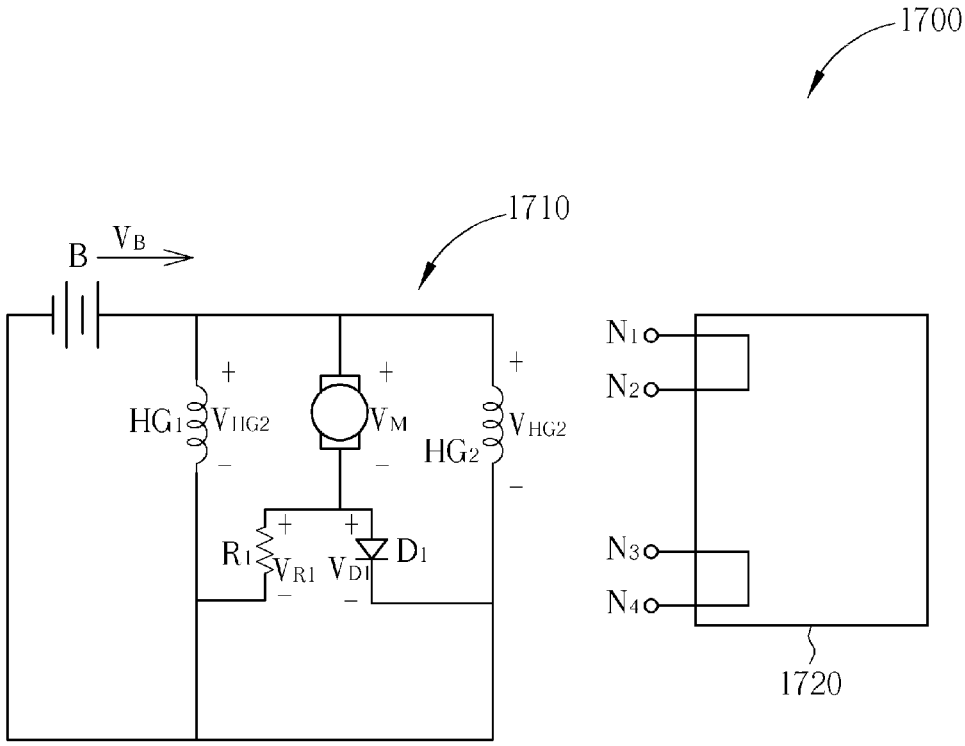
FIG. 19 is a diagram illustrating the dryer circuit of FIG. 17 operating in the mode 3.

Please refer to FIG. 19. FIG. 19 is a diagram illustrating the dryer circuit 1700 operating in mode 3. As shown in FIG. 19, the connection controller 1720 connects the node $N_1$ to the node $N_2$, and connects the node $N_3$ to the node $N_4$. Therefore, the electric power provided by the power unit B passes through both the circuit group $G_3$ and $G_4$. Because the resistor $R_1$ is disposed in the circuit group $G_3$, the current flowing through the resistor $R_1$ can be ignored in mode 3. Neglecting the small voltage drops over the diode $D_1$, the voltage on the motor M equals to the voltage $V_B$.

In mode 3, the power consumed respectively by the heating units $HG_1$ and $HG_2$ and the motor M are calculated by the following equations:

$$P_{HG1}=V_B^2/(R_{HG1}) \quad (12)$$

$$P_{HG2}=V_B^2/(R_{HG2}) \quad (13)$$

$$P_M=V_M^2/R_M=V_B^2/R_M \quad (14)$$

wherein the $P_{HG1}$ and $P_{HG2}$ respectively represent the power consumed by the heat units $HG_1$ and $HG_2$, and $R_{HG1}$ and $R_{HG2}$ respectively represent the equivalent impedances of the heat units $HG_1$ and $HG_2$. The calculation of the power consumptions on the components in the main circuit 1710 in mode 3 is similar to FIG. 7 and is omitted.

Figure 20:
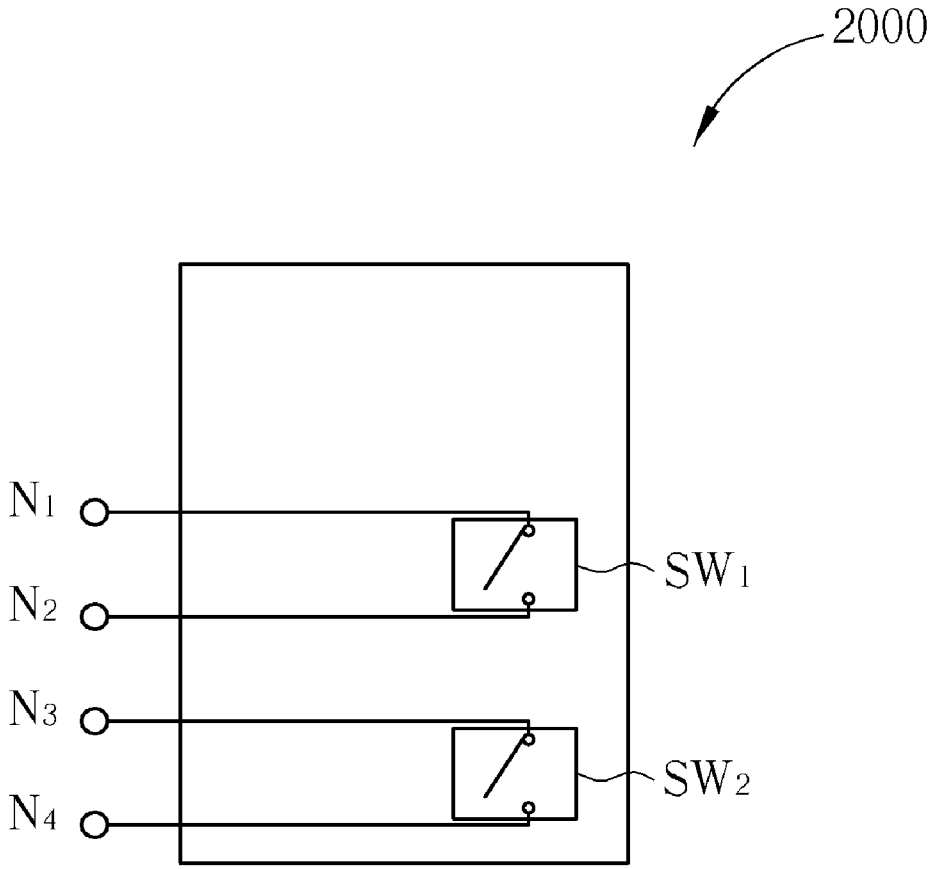
FIG. 20 is a diagram illustrating a first connection controller of the second embodiment of the present invention.

Please refer to FIG. 20. FIG. 20 is a diagram illustrating a first connection controller 2000 of the second embodiment of the present invention. As shown in FIG. 20, the connection controller 2000 comprises two switches $SW_1$ and $SW_2$ respectively for the connection between the nodes $N_1$ and $N_2$ and the connection between the nodes $N_3$ and $N_4$. The switches $SW_1$ and $SW_2$ are respectively controlled to achieve the operation of the dryer circuit 1700 in modes 0, 1 and 3. In the connection controller 2000, the switches $SW_1$ and $SW_2$ can be mechanical switches.

Figure 21:
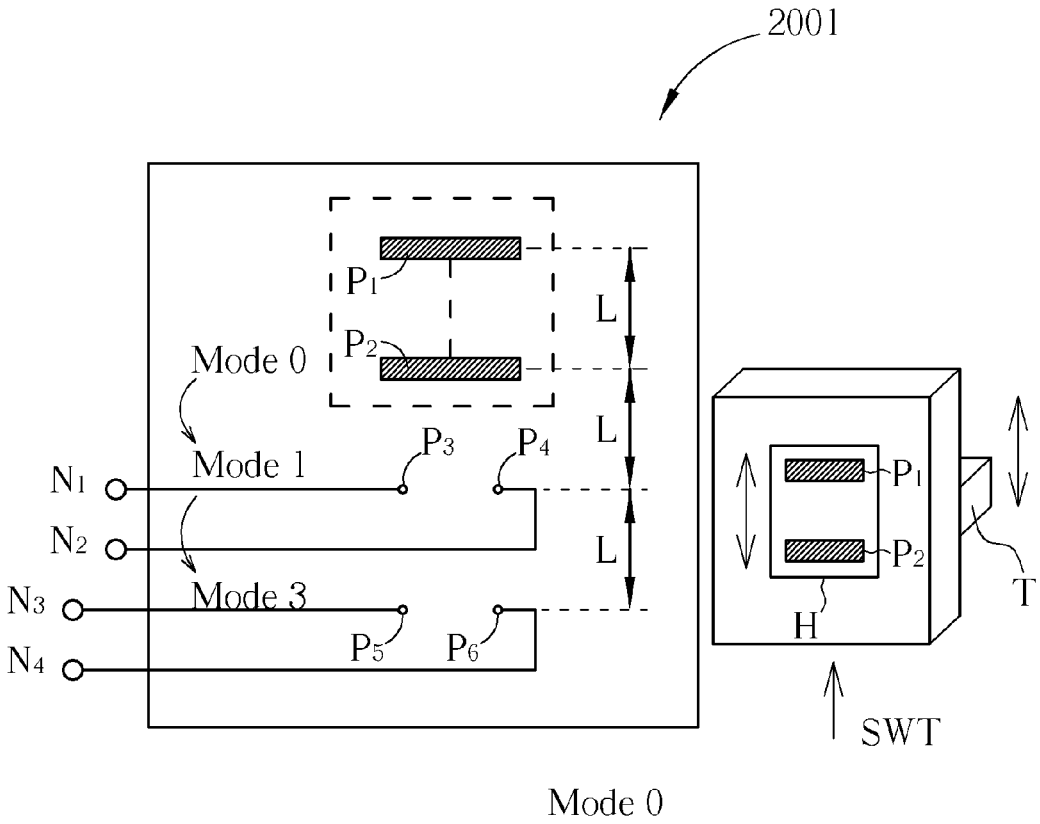
FIG. 21 is a diagram illustrating a second connection controller of the second embodiment of the present invention.

Please refer to FIG. 21. FIG. 21 is a diagram illustrating the connection controller 2001 based on the connection controller 2000 and utilizing a slide switch SWT of the present invention. As shown in FIG. 21, the slide switch SWT comprises a base H, a slide button T and two conducting pads $P_1$ and $P_2$. The slide switch SWT is disposed for controlling the connection between the nodes $N_1$ and $N_2$ and the connection between the nodes $N_3$ and $N_4$. The conducting pads $P_3$ and $P_4$ are disposed for the nodes $N_1$ and $N_2$, and the conducting pads $P_5$ and $P_6$ are disposed for the nodes $N_3$ and $N_4$. The dryer circuit 1700 operates in modes 0, 1 and 3 according to the movement of the slide button T of the slide switch SWT.

In FIG. 21, by default setting, the connection controller 2001 achieves mode 0 operation for the dryer circuit 1700 by disposing the slide button T in a position that both the conducting pads $P_1$ and $P_2$ do not contact with the pads $P_3$, $P_4$, $P_5$, and $P_6$.

Figure 22:
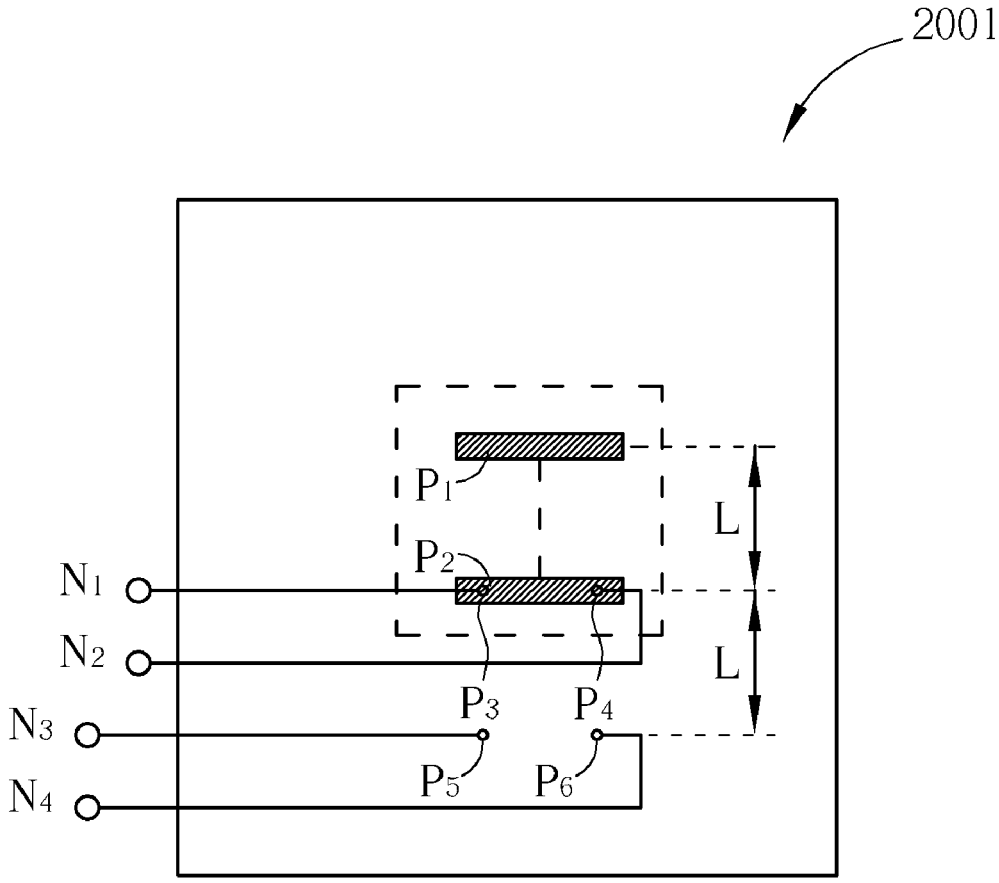
FIG. 22 is a diagram illustrating the connection controller of FIG. 21 in the mode 1.

Please refer to FIG. 22. FIG. 22 is a diagram illustrating the connection controller 2001 in mode 1. As shown in FIG. 22, the slide button T moves downward so that the conducting pad $P_2$ contacts with the conducting pads $P_3$ and $P_4$ in order to establish the connection between the nodes $N_1$ and $N_2$. Therefore, the nodes $N_1$ and $N_2$ are short-circuited by the conducting pad $P_2$, and consequently the dryer circuit 1700 operates in mode 1.

Figure 23:
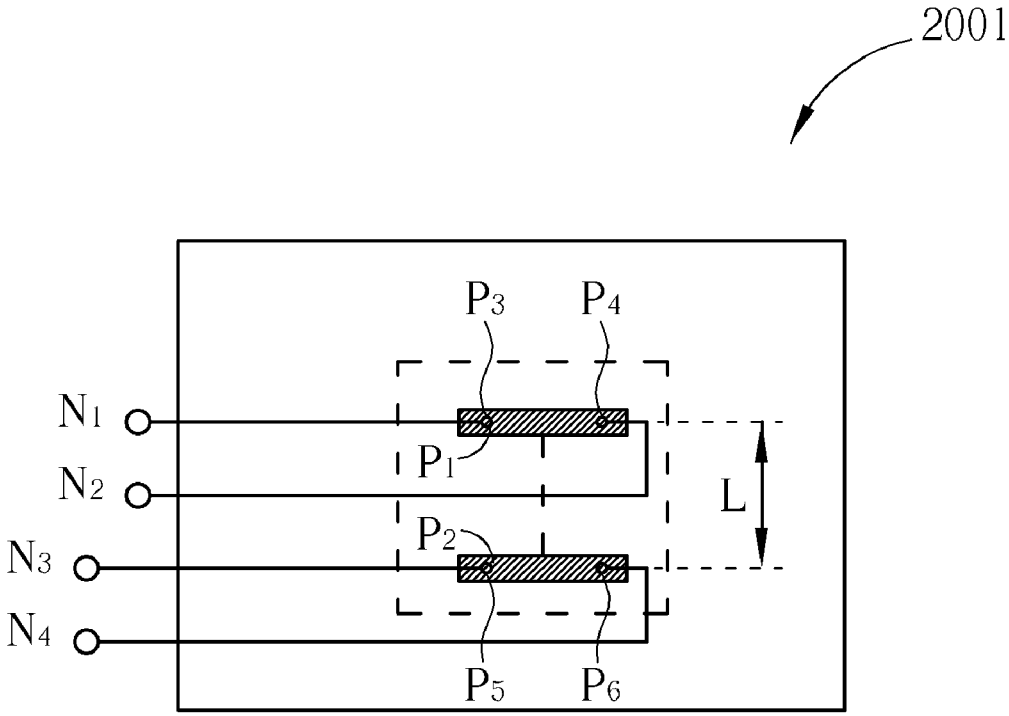
FIG. 23 is a diagram illustrating the connection controller of FIG. 21 in the mode 3.

Please refer to FIG. 23. FIG. 23 is a diagram illustrating the connection controller 2001 in mode 3. As shown in FIG. 23, the slide button T moves further downward so that the conducting pad $P_2$ contacts with the conducting pads $P_5$ and $P_6$ in order to establish the connection between the nodes $N_3$ and $N_4$, and the conducting pad $P_1$ contacts with the conducting pads $P_3$ and $P_4$ in order to establish the connection between the nodes $N_1$ and $N_2$. Therefore, the nodes $N_1$ and $N_2$ are short-circuited by the conducting pad $P_1$, the nodes $N_3$ and $N_4$ are short-circuited by the conducting pad $P_2$, and consequently the dryer circuit 1700 operates in mode 3.

Figure 24:
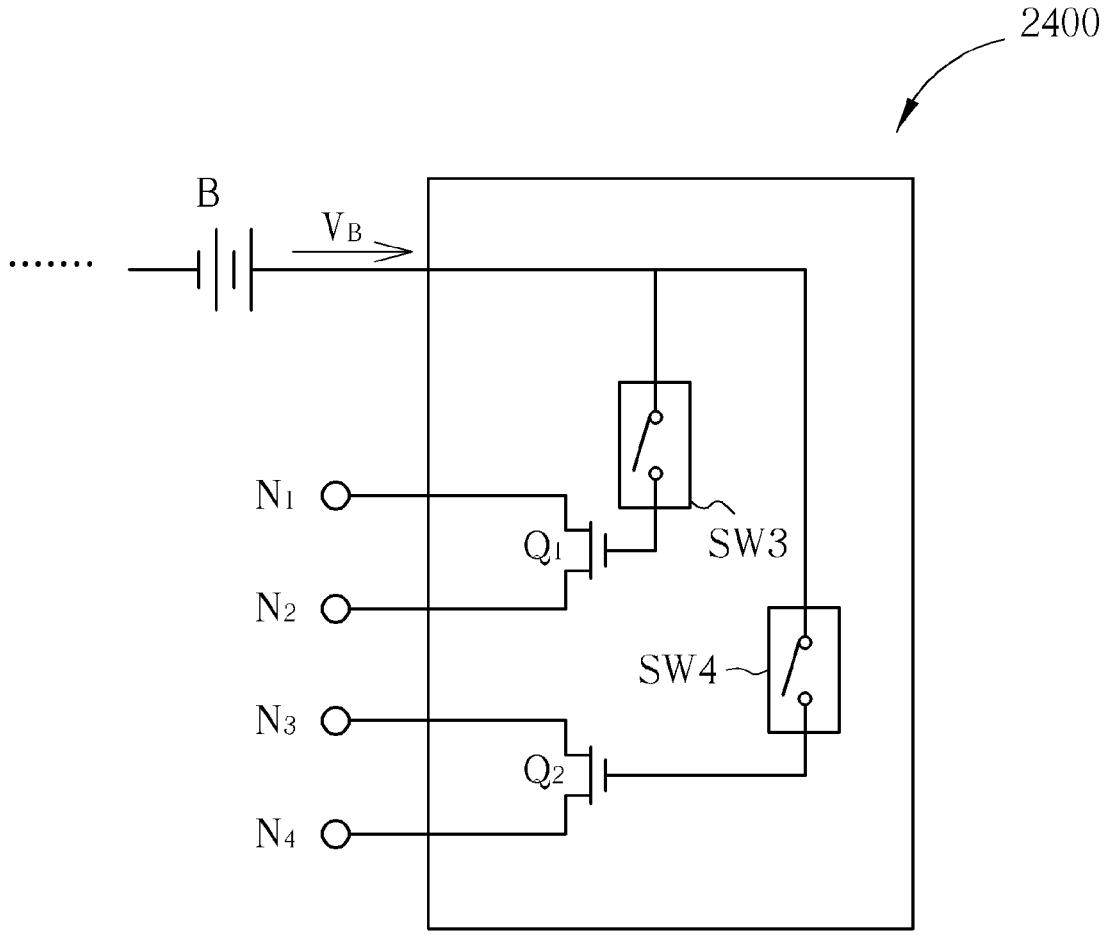
FIG. 24 is a diagram illustrating a third connection controller of the second embodiment of the present invention.

Please refer to FIG. 24. FIG. 24 is a diagram illustrating another connection controller 2400 of the second embodiment of the present invention. As shown in FIG. 24, the connection controller 2400 comprises a transistor $Q_1$ controlled by a switch $SW_3$ for the connection between the nodes $N_1$ and $N_2$, and a transistor $Q_2$ controlled by a switch $SW_4$ for the connection between the nodes $N_3$ and $N_4$. The transistor $Q_1$ connects the node $N_1$ to the node $N_2$ when the switch $SW_3$ is short-circuited for transmitting the voltage $V_B$ from the power unit B and the control end of the transistor $Q_1$ receives the voltage $V_B$ from the power unit B. The transistor $Q_2$ connects the node $N_3$ to the node $N_4$ when the switch $SW_4$ is short-circuited for transmitting the voltage $V_B$ from the power unit B and the control end of the transistor $Q_2$ receives the voltage $V_B$ from the power unit B. The voltages on the control ends of the transistors $Q_1$ and $Q_2$ for actuating the transistors $Q_1$ and $Q_2$ can be positive or negative, depending on the transistors being forward-biased or reverse-biased. The switches $SW_3$ and $SW_4$ are coupled in parallel for being respectively controlled in order to achieve the operation of the dryer circuit 1700 in modes 0, 1 and 3.

Figure 25:
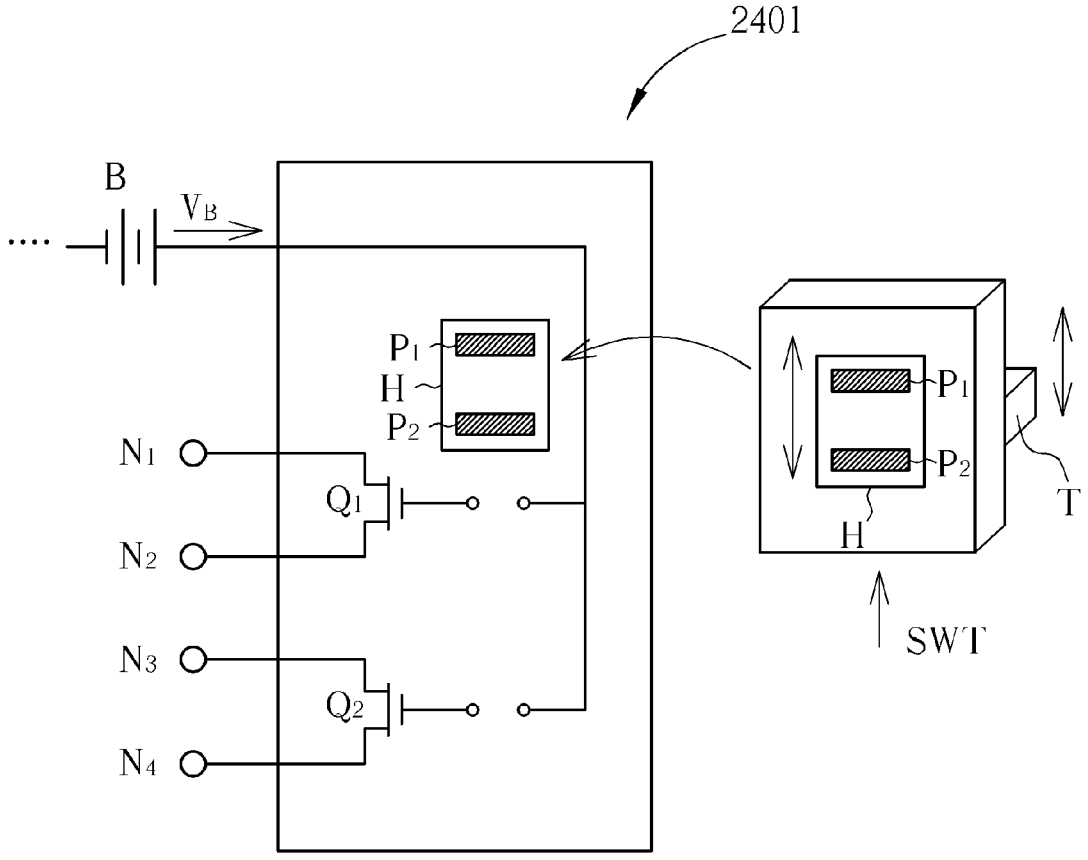
FIG. 25 is a diagram illustrating a fourth connection controller of the second embodiment of the present invention.

Please refer to FIG. 25. FIG. 25 is a diagram illustrating the connection controller 2401 based on the connection controller 2400 and utilizing a slide switch SWT of the present invention. As shown in FIG. 25, the slide switch SWT is disposed for controlling the connection between the nodes $N_1$ and $N_2$ and the connection between the nodes $N_3$ and $N_4$. The dryer circuit 1700 operates in modes 0, 1 and 3 according to the movement of the slide button T of the slide switch SWT as described from FIG. 21 to FIG. 23 and the related description is omitted.

Figure 26:
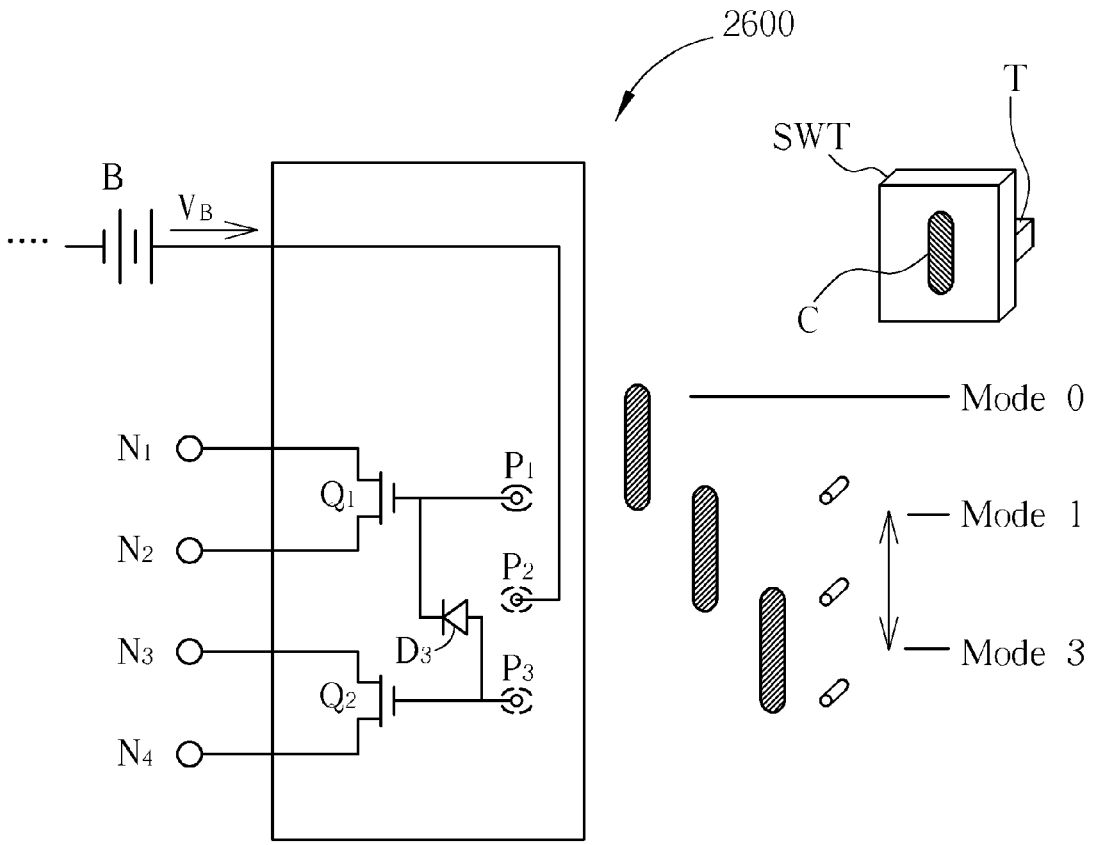
FIG. 26 is a diagram illustrating a fifth connection controller of the second embodiment of the present invention.

Please refer to FIG. 26. FIG. 26 is a diagram illustrating another connection controller 2600 of the second embodiment of the present invention. As shown in FIG. 26, the connection controller 2600 comprises two transistors $Q_1$ and $Q_2$ both controlled by a slide switch SWT, a pad $P_2$ connected to the power unit B, a pad $P_1$ connected to the control end of transistor $Q_1$, and a pad $P_3$ connected to the control end of transistor $Q_1$ through diode $D_3$ and to the control end of transistor $Q_2$. The slide switch SWT comprises a base H, a slide button T, and a conducting pad C.

By default setting, the connection controller 3200 achieves mode 0 operation for the dryer circuit 1700 by disposing the slide button T in a position that conducting pad C contacts with no pads but only the pad $P_1$.

When the slide button T of the slide switch SWT shifts to the position for mode 1, the pad $P_1$ and the pad $P_2$ are short-circuited by the conducting pad C, so the control end of the transistor $Q_1$ receives the voltage $V_B$ from the power unit B. Therefore, the transistor $Q_1$ connects the node $N_1$ to the node $N_2$. The diode $D_3$ prevents the transistor $Q_2$ from receiving the voltage $V_B$ from the power unit B when the pad $P_1$ and the pad $P_2$ are short-circuited.

When the slide button T of the slide switch SWT shifts to the position for mode 3, the pad $P_2$ and the pad $P_3$ are short-circuited by the conducting pad C, so both the control ends of the transistors $Q_1$ and $Q_2$ receive the voltage $V_B$ from the power unit B. Therefore, the transistor $Q_1$ connects the node $N_1$ to the node $N_2$ and the transistor $Q_2$ connects the node $N_3$ to the node $N_4$.

In summary, the dryer circuit 1700 can operate in modes 0, 1, and 3 by shifting the slide button T of the slide switch SWT to different positions.

Figure 27:
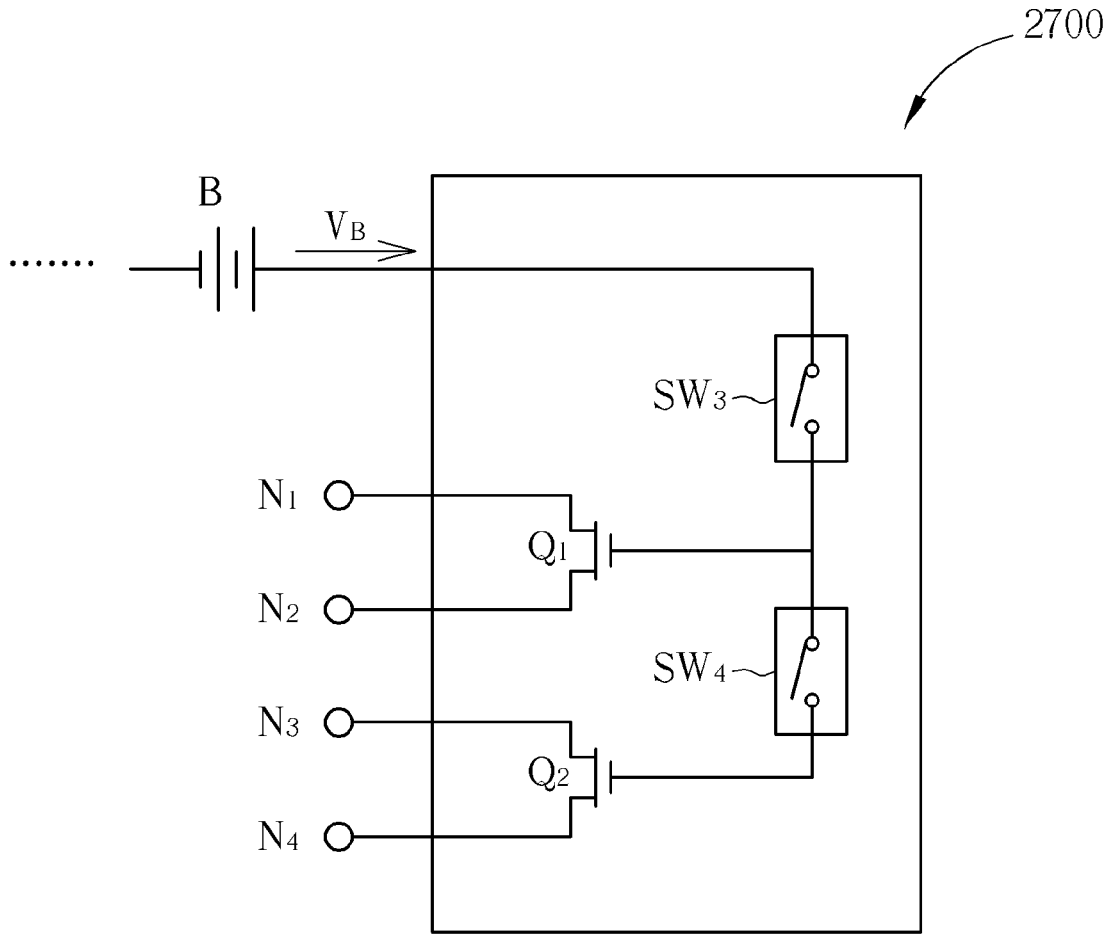
FIG. 27 is a diagram illustrating a sixth connection controller of the second embodiment of the present invention.

Please refer to FIG. 27. FIG. 27 is a diagram illustrating another connection controller 2700 of the second embodiment of the present invention. As shown in FIG. 27, the connection controller 2700 comprises a transistor $Q_1$ controlled by a switch $SW_3$ for the connection between the nodes $N_1$ and $N_2$, and a transistor $Q_2$ controlled by a switch $SW_4$ for the connection between the nodes $N_3$ and $N_4$. The transistor $Q_1$ connects node $N_1$ to node $N_2$ when the switch $SW_3$ is short-circuited for transmitting the voltage $V_B$ from the power unit B and the control end of the transistor $Q_1$ receives the voltage $V_B$ from the power unit B. The transistor $Q_2$ connects node $N_3$ to the node $N_4$ only when both switch $SW_3$ and switch $SW_4$ are short-circuited for transmitting the voltage $V_B$ from the power unit B and the control end of the transistor $Q_2$ receives a voltage from the power unit B. The voltages on the control ends of the transistors $Q_1$ and $Q_2$ can be positive or negative, depending on the transistors being forward-biased or reverse-biased. The switches $SW_3$ and $SW_4$ are coupled in series for being respectively controlled to achieve the operation of the dryer circuit 1700 in modes 0, 1 and 3.

Figure 28:
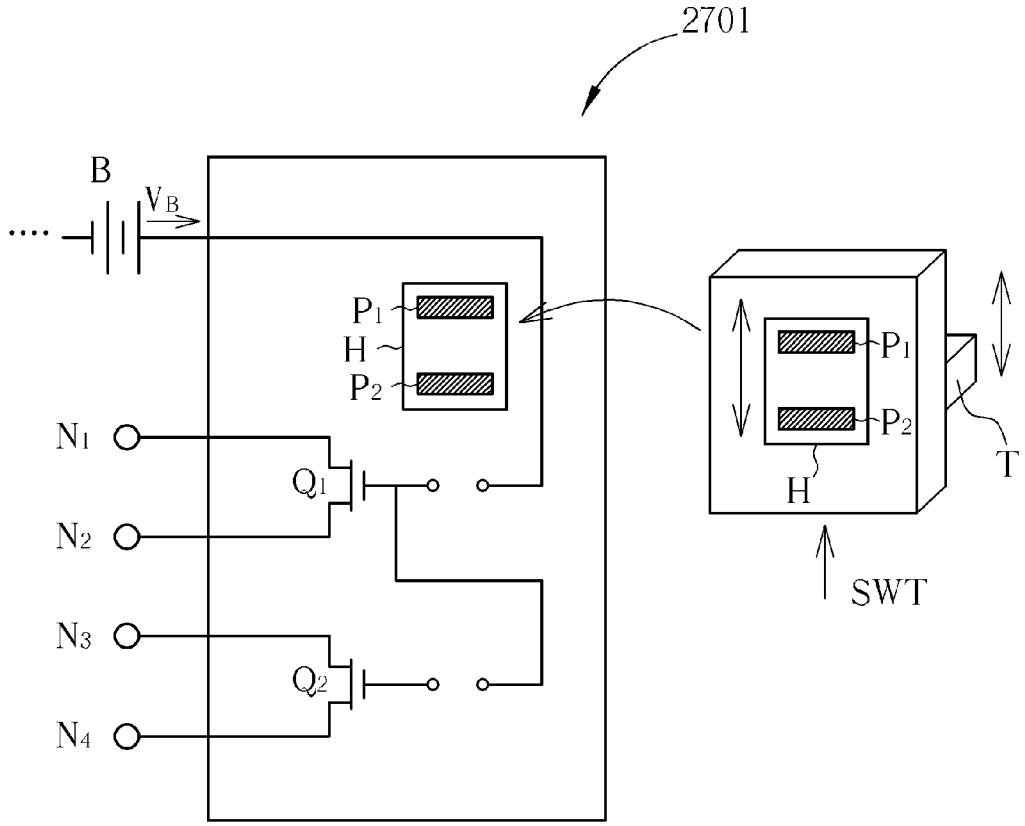
FIG. 28 is a diagram illustrating a seventh connection controller of the second embodiment of the present invention.

Please refer to FIG. 28. FIG. 28 is a diagram illustrating the connection controller 2701 based on the connection controller 2700 and utilizing a slide switch SWT of the present invention. As shown in FIG. 28, the slide switch SWT is disposed for controlling the connection between the nodes $N_1$ and $N_2$ and the connection between the nodes $N_3$ and $N_4$. The dryer circuit 1700 operates in modes 0, 1 and 3 according to the movement of the button T of the slide switch SWT as described from FIG. 21 to FIG. 23 and the related description is omitted.

Figure 29:
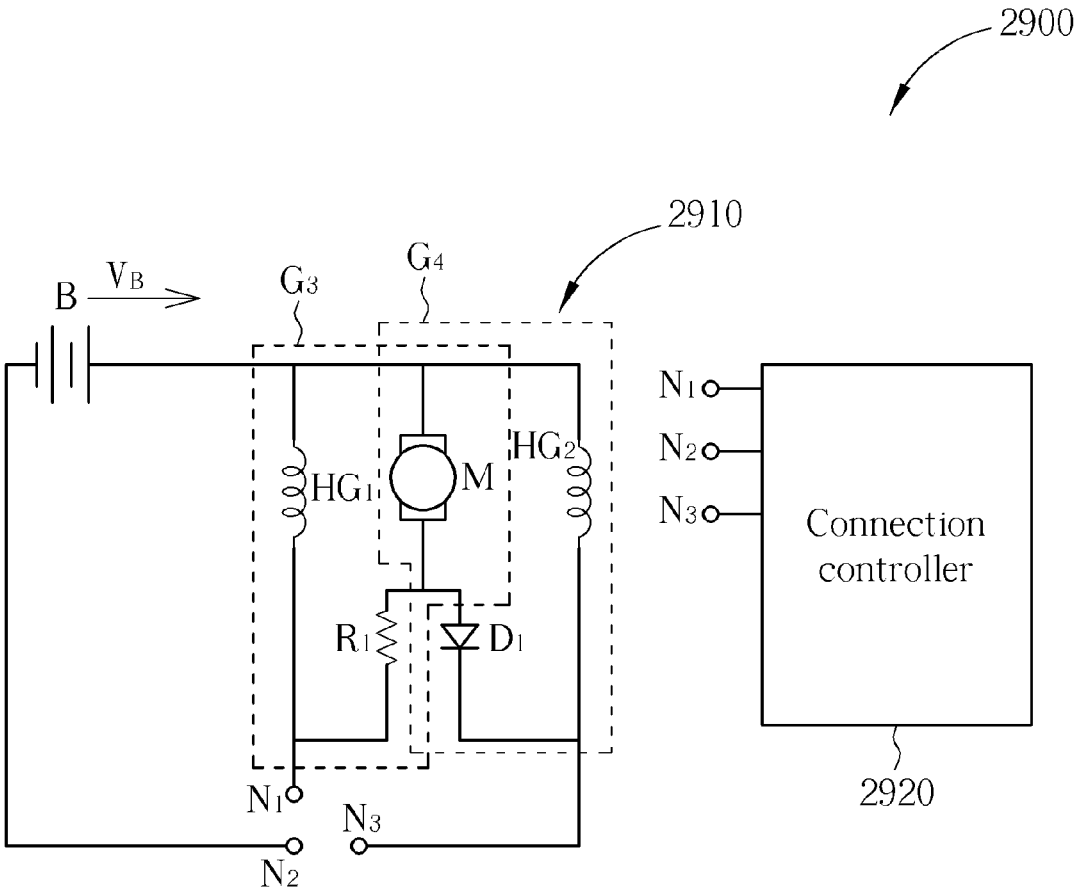
FIG. 29 is a diagram illustrating the dryer circuit according to a third embodiment of the present invention.

Please refer to FIG. 29. FIG. 29 is a diagram illustrating a third embodiment of the present invention. As shown in FIG. 29, the dryer circuit 2900 comprises a main circuit 2910 and a connection controller 2920. The main circuit 2910 comprises a power unit B, a motor M (including a fan), a diode $D_1$, two heating units $HG_1$ and $HG_2$, a resistor $R_1$, and three nodes $N_1$, $N_2$, and $N_3$. The power unit B provides a voltage $V_B$. The heating units $HG_1$ and $HG_2$ generate heat according to power consumed by the heat units $HG_1$ and $HG_2$ respectively. The motor M (including a fan) generates airflow with a volume according to the power consumed by the motor M.

Between the positive end of the power unit B and the node $N_1$, the heating unit $HG_1$, the motor M, and the resistor $R_1$ form a circuit group $G_3$. In the circuit group $G_3$, the motor M and the resistor $R_1$ are coupled in series, and the motor M and the heating unit $HG_1$ are coupled in parallel.

Between the positive end of the power unit B and the node $N_3$, the heating unit $HG_2$, the motor M, and the diode $D_1$, form a circuit group $G_4$. In the circuit group $G_4$, the motor M and the diode $D_1$ are coupled in series, and the motor M and the heating unit $HG_2$ are coupled in parallel.

The connection controller 2920 controls the connection between the nodes $N_1$ and $N_2$, and the connection between the nodes $N_2$ and $N_3$, respectively. Therefore, by controlling the current to flow through the circuit groups $G_3$, or both the circuit groups $G_3$ and $G_4$, different modes of the dryer circuit 2900 are achieved.

The dryer circuit 2900 utilizes the connection controller 2920 to perform the same operating modes 0, 1 and 3 as described from FIG. 17 to FIG. 19 for the dryer circuit 1700 and the related description is omitted. The calculations of the power consumptions on the components in the main circuit 2910 in modes 1 and 3 are similar to FIG. 3 and FIG. 7, which are also omitted.

Figure 30:
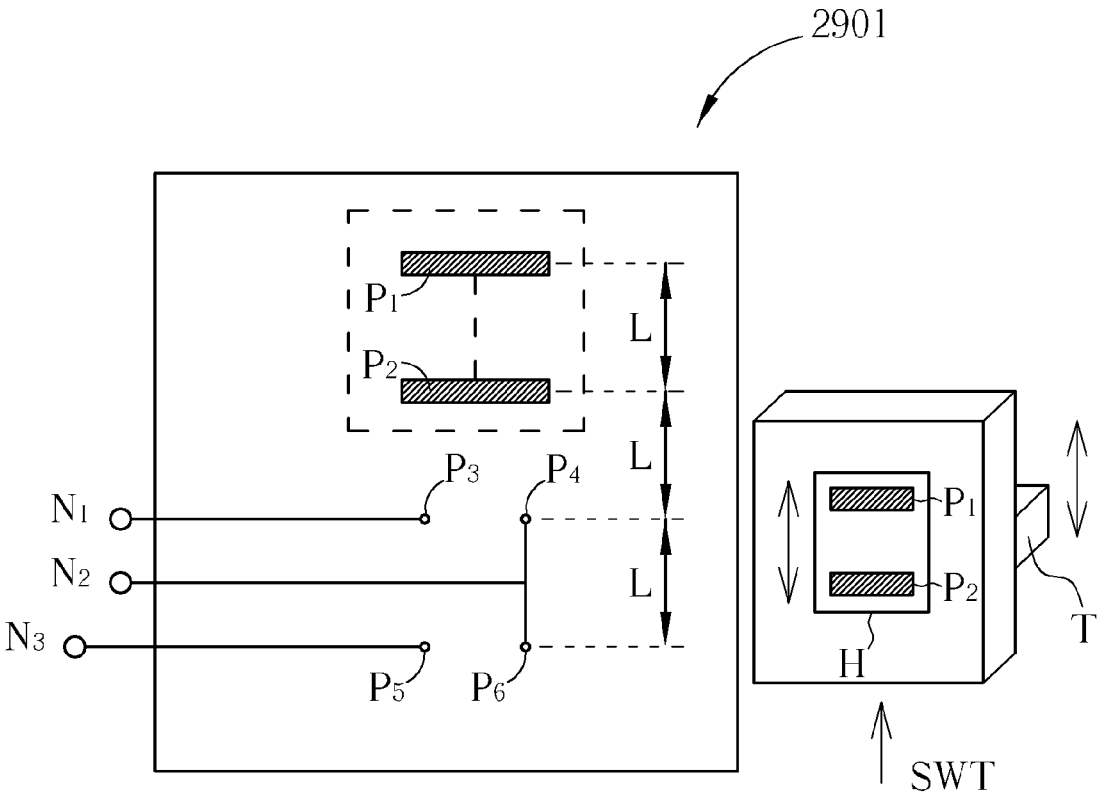
FIG. 30 is a diagram illustrating a first connection controller of the third embodiment of the present invention.

Please refer to FIG. 30. FIG. 30 is a diagram illustrating a first connection controller 2901 of the third embodiment of the present invention. As shown in FIG. 30, the slide switch SWT is disposed for controlling the connection between the nodes $N_1$ and $N_2$ and the connection between the nodes $N_2$ and $N_3$. The dryer circuit 2900 operates in modes 0, 1 and 3 according to the movement of the slide button T of the slide switch SWT as described from FIG. 21 to FIG. 23 and the related description is omitted.

Figure 31:
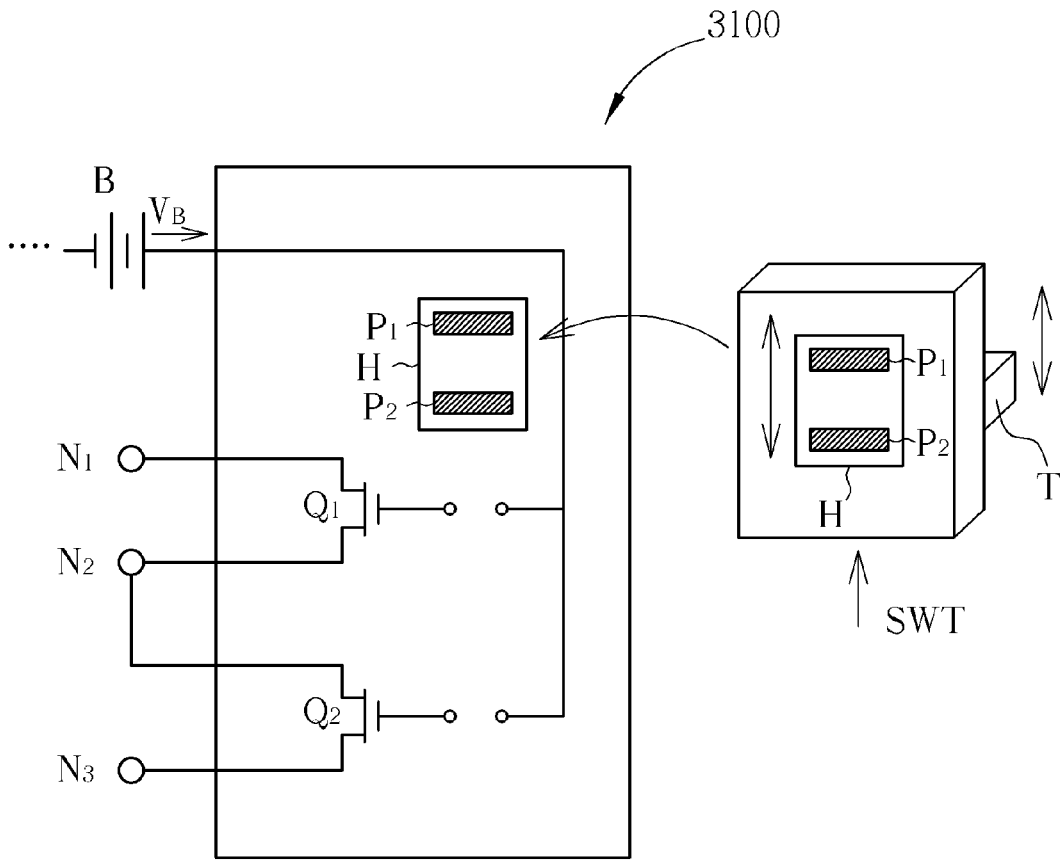
FIG. 31 is a diagram illustrating a second connection controller of the third embodiment of the present invention.

Please refer to FIG. 31. FIG. 31 is a diagram illustrating another connection controller 3100 of the third embodiment of the present invention. As shown in FIG. 31, the connection controller 3100 comprises a transistor $Q_1$ for the connection between the nodes $N_1$ and $N_2$, a transistor $Q_2$ for the connection between the nodes $N_2$ and $N_3$, and a slide switch SWT for controlling both transistors $Q_1$ and $Q_2$. The voltage on the control ends of the transistors $Q_1$ and $Q_2$ can be positive or negative, depending on the transistors being forward-biased or reverse-biased. The dryer circuit 2900 operates in modes 0, 1 and 3 according to the movement of the slide switch SWT also as described from FIG. 21 to FIG. 23 and the related description is omitted.

Figure 32:
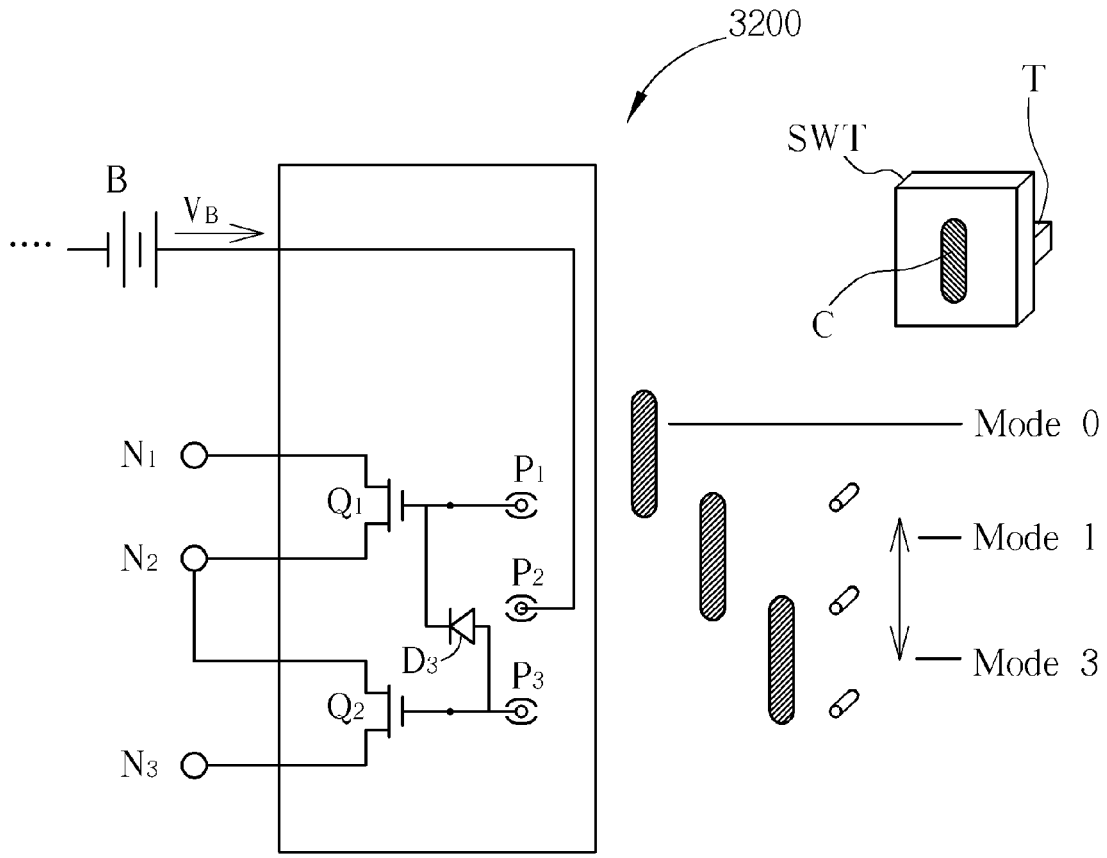
FIG. 32 is a diagram illustrating a third connection controller of the third embodiment of the present invention.

Please refer to FIG. 32. FIG. 32 is a diagram illustrating another connection controller 3200 of the third embodiment of the present invention. As shown in FIG. 32, the connection controller 3200 comprises two transistors $Q_1$ and $Q_2$ both controlled by a slide switch SWT, a pad $P_2$ connected to the power unit B, a pad $P_1$ connected to the control end of transistor $Q_1$, and a pad $P_3$ connected to the control end of transistor $Q_1$ through diode $D_3$ and to the control end of transistor $Q_2$. The slide switch SWT comprises a base H, a slide button T, and a conducting pad C. The dryer circuit 2900 operates in modes 0, 1 and 3 according to the movement of the slide button T of the slide switch SWT as described in FIG. 26 and the related description is omitted.

Figure 33:
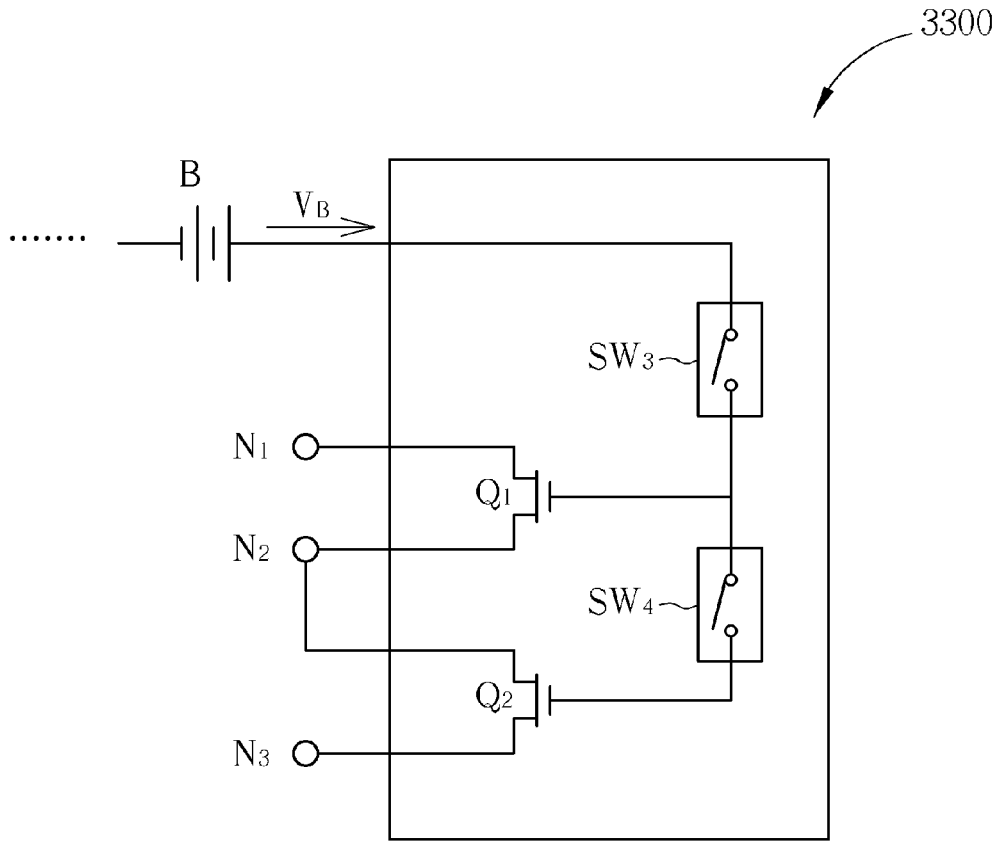
FIG. 33 is a diagram illustrating a fourth connection controller of the third embodiment of the present invention.

Please refer to FIG. 33. FIG. 33 is a diagram illustrating another connection controller 3300 of the third embodiment of the present invention. As shown in FIG. 33, the connection controller 3300 comprises a transistor $Q_1$ controlled by a switch $SW_3$ for the connection between the nodes $N_1$ and $N_2$, and a transistor $Q_2$ controlled by a switch $SW_4$ for the connection between the nodes $N_2$ and $N_3$. The switches $SW_3$ and $SW_4$ are coupled in series for respectively being controlled to achieve the operation of the dryer circuit 2900 in modes 0, 1 and 3 as described in FIG. 27 and the related description is omitted.

Figure 34:
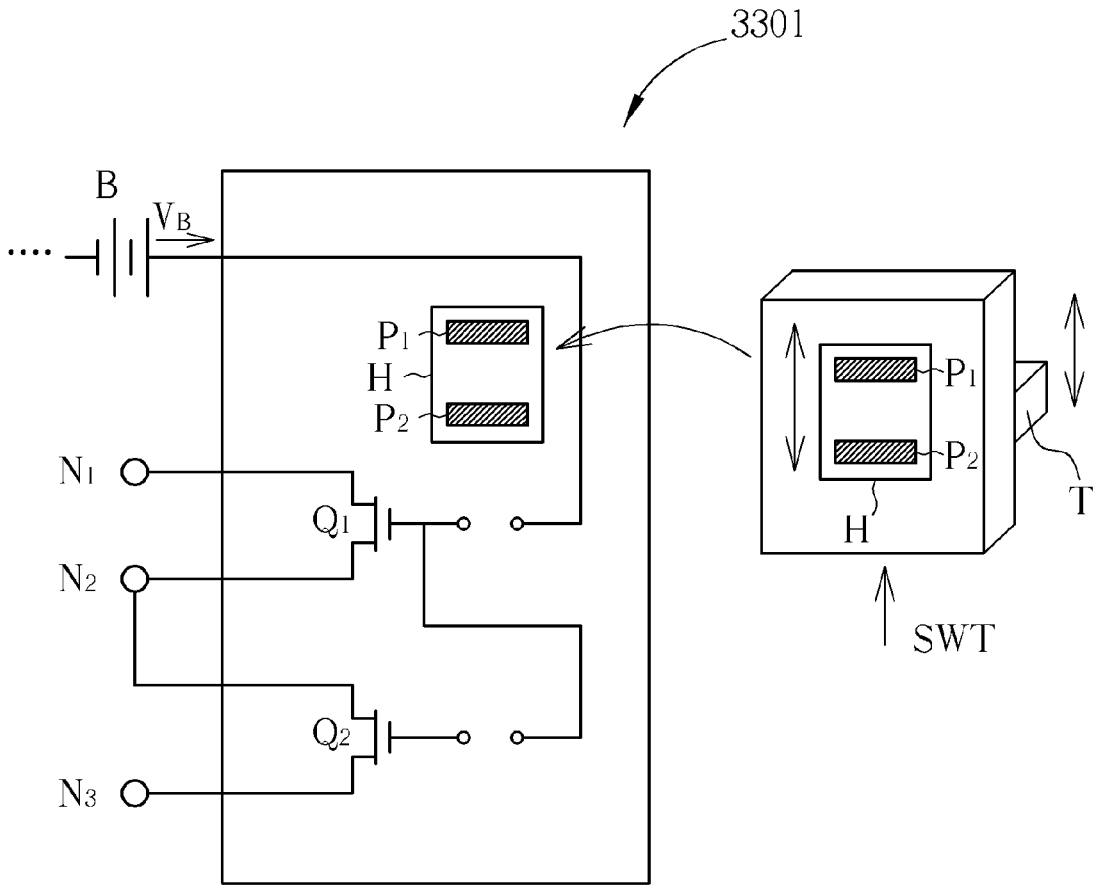
FIG. 34 is a diagram illustrating a fifth connection controller of the third embodiment of the present invention.

Please refer to FIG. 34. FIG. 34 is a diagram illustrating the connection controller 3301 based on the connection controller 3300 and utilizing a slide switch SWT of the present invention. As shown in FIG. 34, the slide switch SWT is disposed for controlling the connection between the nodes $N_1$ and $N_2$ and the connection between the nodes $N_2$ and $N_3$. The dryer circuit 2900 operates in modes 0, 1 and 3 according to the movement of the slide button T of the slide switch SWT as described from FIG. 21 to FIG. 23 and the related description is omitted.

Figure 35:
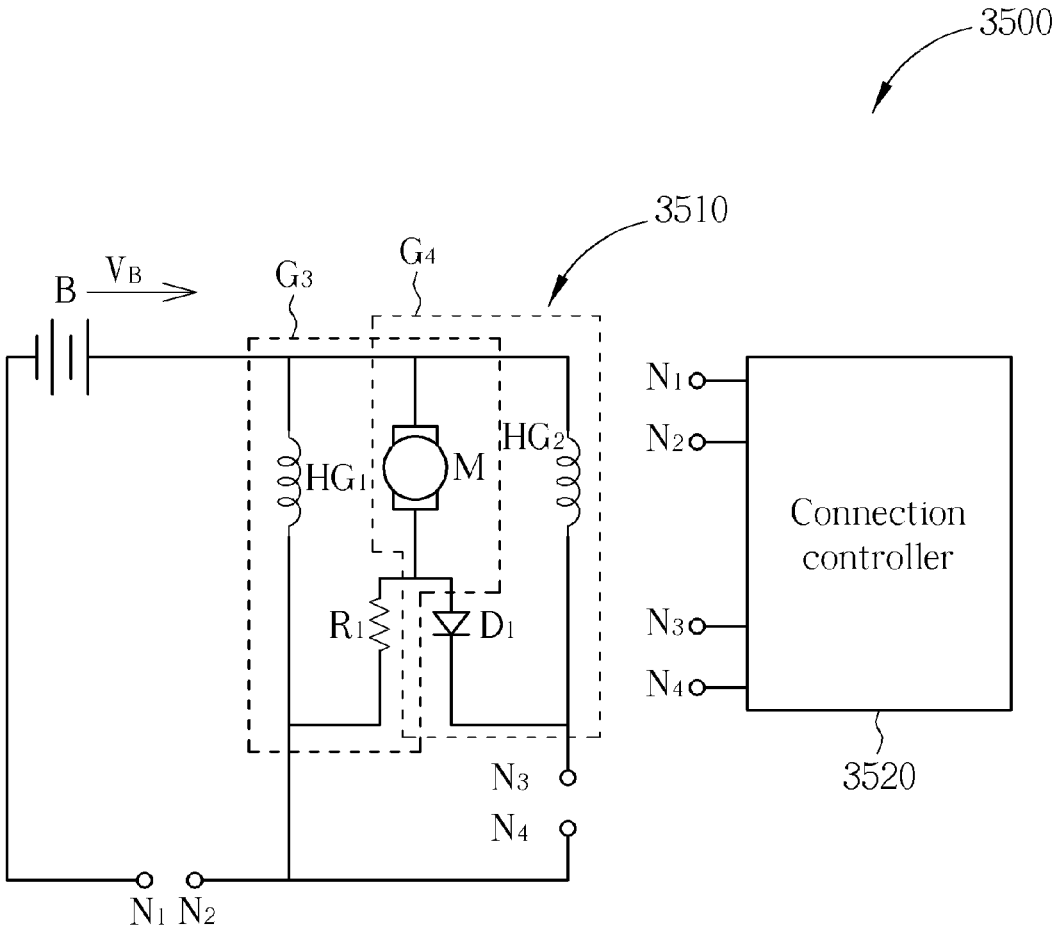
FIG. 35 is a diagram illustrating alternative embodiment of the second embodiment of the present invention.

Please refer to FIG. 35. FIG. 35 is a diagram illustrating alternative embodiment of the second embodiment of the present invention. As shown in FIG. 35, the dryer circuit 3500 is similar to the dryer circuit 1700 in FIG. 17, but the difference between the two dryer circuits is: the node $N_1$ is disposed at the second end of the power unit B, and the node $N_2$ is disposed at the second end of the heating unit $HG_1$.

Additionally, the power unit mentioned in the present invention can be realized with battery, rechargeable battery, fuel cell, micro-engine, or any device providing electric power and should not be limited to the embodiments mentioned above. The heating units mentioned in the present invention can be realized with heating filaments, or any devices with impedance for generating heat by consuming electric power and should not be limited to the embodiment mentioned above. The transistors mentioned in the present invention can be realized with any electronic switches including but not limited to MOSFET (metal-oxide semiconductor field-effect transistor), JFET (junction field-effect transistor), SCR (silicon-controlled rectifier), UJT (uni-junction transistor) and so on. Further, the resistor mentioned in the present invention also can be replaced by and utilized as a heating unit, and the slide switch mentioned in the present invention also can be replaced with other kinds of switches such as rotary switches or push-button switches.

To sum up, the present invention provides various innovative dryer circuits to achieve multi-setting of the portable dryer. Particularly, the dry circuits utilize the connection controller to control the power consumed by the motor and the power consumed by the heating units at the same time for generating various volume of airflow at the desired heat output.

Those skilled in the art will readily observe that numerous modifications and alterations of the device and method may be made while retaining the teachings of the invention.

What is claimed is:

1. A dryer circuit comprising:

a main circuit, comprising:

a power unit, comprising:

a first end for providing a first predetermined voltage; and a second end for providing a second predetermined voltage;

a first heating unit, comprising:

a first end coupled to the first end of the power unit; and a second end;

a second heating unit, comprising:

a first end coupled to the first end of the power unit; and a second end;

a fan motor, comprising:

a first end coupled to the first end of the power unit; and a second end;

a diode coupled between the second end of the second heating unit and the second end of the fan motor; and a resistor coupled between the second of the first heating unit and the second end of the fan motor; and a connection controller coupled to the second end of the first heating unit, the second end of the second heating unit, and the second end of the power unit for switching coupling of the second end of the first heating unit to the second end of the power unit and switching coupling of the second end of the second heating unit to the second end of the power unit;

wherein the connection controller comprises:

a first electronic switch, comprising:

a first end coupled to the second end of the first heating unit;

a second end coupled to the second end of the power unit; and a control end;

wherein the first end of the first electronic switch is coupled to the second end of the first electronic switch when the control end of the first electronic switch receives the first predetermined voltage;

a second electronic switch, comprising:

a first end coupled to the second end of the second heating unit;

a second end coupled to the second end of the power unit; and a control end;

wherein the first end of the second electronic switch is coupled to the second end of the second electronic switch when the control end of the second electronic switch receives the first predetermined voltage; and a switching device for coupling the control end of the first electronic switch to the first end of the power unit or coupling both the control ends of the first and the second electronic switches to the first end of the power unit.

2. The dryer circuit of claim 1, wherein the switching device comprises:

a first conducting pad coupled to the first end of the power unit;

a second conducting pad coupled to the first end of the power unit;

a third conducting pad coupled to the control end of the first electronic switch;

a fourth conducting pad coupled to the control end of the second electronic switch; and a slide switch, comprising:

a slide button;

a first contact; and a second contact;

wherein when the slide button moves to a first position, the first contact is accordingly moved for coupling the first conducting pad to the third conducting pad, and when the slide button moves to a second position, the first contact is accordingly moved for coupling the second conducting pad to the fourth conducting pad and the second contact is accordingly moved for coupling the first conducting pad to the third conducting pad.

3. The dryer circuit of claim 1, wherein the switching device comprises:

a first conducting pad coupled to the first end of the power unit;

a second conducting pad coupled to the control end of the first electronic switch;

a diode coupled between the control end of the first electronic switch and the control end of the second electronic switch;

a third conducting pad coupled to the control end of the second electronic switch; and a slide switch, comprising:

a slide button; and a contact;

wherein when the slide button moves to a first position, the contact is accordingly moved for coupling the first conducting pad to the second conducting pad; when the slide button moves to a second position, the contact is accordingly moved for coupling the first conducting pad to the third conducting pad.

4. The dryer circuit of claim 1, wherein the switching device comprises:

a first switch coupled between the first end of the power unit and the control end of the first electronic switch for selectively transmitting the first predetermined voltage to the control end of the first electronic switch; and a second switch coupled between the first switch and the control end of the second electronic switch for selectively transmitting the first predetermined voltage to the control end of the second electronic switch only if the first switch transmits the first predetermined voltage to the control end of the first electronic switch.

5. The dryer circuit of claim 1, wherein the switching device comprises:

a first conducting pad coupled to the first end of the power unit;

a second conducting pad coupled to the control end of the first electronic switch;

a third conducting pad coupled to the control end of the first electronic switch;

a fourth conducting pad coupled to the control end of the second electronic switch; and a slide switch, comprising:

a slide button;

a first contact; and a second contact;

wherein when the slide button moves to a first position, the first contact is accordingly moved for coupling the first conducting pad to the second conducting pad; when the slide button moves to a second position, the first contact is accordingly moved for coupling the third conducting pad to the fourth conducting pad, and the second contact is accordingly moved for coupling the first conducting pad to the second conducting pad.

6. A dryer circuit comprising:

a main circuit, comprising:

a power unit, comprising:

a first end for providing a first predetermined voltage; and a second end for providing a second predetermined voltage;

a first heating unit, comprising:

a first end coupled to the first end of the power unit; and a second end;

a second heating unit, comprising:

a first end coupled to the first end of the power unit; and a second end;

a fan motor, comprising:

a first end coupled to the first end of the power unit; and a second end;

a diode coupled between the second end of the second heating unit and the second end of the fan motor; and a resistor coupled between the second of the first heating unit and the second end of the fan motor;

a connection controller coupled to the second end of the first heating unit, the second end of the second heating unit, and the second end of the power unit for switching coupling of the second end of the first heating unit to the second end of the power unit and switching coupling of the second end of the second heating unit to the second end of the power unit; and a second diode coupled to the resistor in series and coupled between the second end of the fan motor and the second end of the first heating unit;

wherein the connection controller comprises a switching device for coupling the second end of the first heating unit to the second end of the power unit or coupling the second end of the second heating unit to the second end of the power unit, and the switching device comprises:

a first conducting pad coupled to the second end of the first heating unit;

a second conducting pad coupled to the second end of the power unit;

a third conducting pad coupled to the second end of the second heating unit;

a fourth conducting pad coupled to the second end of the power unit; and a slide switch comprising:

a slide button;

a first contact; and a second contact;

wherein when the slide button moves to a first position, the first contact is accordingly moved for coupling the first conducting pad and the second conducting pad; when the slide button moves to a second position, the first contact is accordingly moved for coupling the third conducting pad and the fourth conducting pad; when the slide button moves to a third position, the first contact is accordingly moved for coupling the third conducting pad and the fourth conducting pad, and the second contact is accordingly moved for coupling the first conducting pad and the second conducting pad.

7. A dryer circuit comprising:

a main circuit, comprising:

a power unit, comprising:

a first end for providing a first predetermined voltage; and a second end for providing a second predetermined voltage;

a first heating unit, comprising:

a first end coupled to the first end of the power unit; and a second end;

a second heating unit, comprising:

a first end coupled to the first end of the power unit; and a second end;

a fan motor, comprising:

a first end coupled to the first end of the power unit; and a second end;

a diode coupled between the second end of the second heating unit and the second end of the fan motor; and a resistor coupled between the second of the first heating unit and the second end of the fan motor;

a connection controller coupled to the second end of the first heating unit, the second end of the second heating unit, and the second end of the power unit for switching coupling of the second end of the first heating unit to the second end of the power unit and switching coupling of the second end of the second heating unit to the second end of the power unit; and a second diode coupled to the resistor in series and coupled between the second end of the fan motor and the second end of the first heating unit;

wherein the connection controller comprises:

a first electronic switch, comprising:

a first end coupled to the second end of the first heating unit;

a second end coupled to the second end of the power unit; and a control end;

wherein the first end of the first electronic switch is coupled to the second end of the first electronic switch when the control end of the first electronic switch receives the first predetermined voltage;

a second electronic switch, comprising:

a first end coupled to the second end of the second heating unit;

a second end coupled to the second end of the power unit; and a control end;

wherein the first end of the second electronic switch is coupled to the second end of the second electronic switch when the control end of the second electronic switch receives the first predetermined voltage; and a switching device for coupling the control end of the first electronic switch to the first end of the power unit, or coupling the control end of the second electronic switch to the first end of the power unit, or coupling both the control ends of the first and the second electronic switches to the first end of the power unit.

8. The dryer circuit of claim 7, wherein the switching device comprises:

a first switch coupled between the first end of the power unit and the control end of the first electronic switch for selectively transmitting the first predetermined voltage to the control end of the first electronic switch; and a second switch coupled between the first end of the power unit and the control end of the second electronic switch for selectively transmitting the first predetermined voltage to the control end of the second electronic switch.

9. The dryer circuit of claim 7, wherein the switching device comprises:

a first conducting pad coupled to the first end of the power unit;

a second conducting pad coupled to the first end of the power unit;

a third conducting pad coupled to the control end of the first electronic switch;

a fourth conducting pad coupled to the control end of the second electronic switch; and a slide switch, comprising:

a slide button;

a first contact; and a second contact;

wherein when the slide button moves to a first position, the first contact is accordingly moved for coupling the first conducting pad and the third conducting pad; when the slide button moves to a second position, the first contact is accordingly moved for coupling the second conducting pad and the fourth conducting pad; when the slide button moves to a third position, the first contact is accordingly moved for coupling the second conducting pad and the fourth conducting pad, and the second contact is accordingly moved for coupling the first conducting pad and the third conducting pad.

10. The dryer circuit of claim 7, wherein the switching device comprises:

a first conducting pad coupled to the first end of the power unit;

a second conducting pad coupled to the first end of the power unit;

a third conducting pad coupled to the first end of the power unit;

a fourth conducting pad coupled to the control end of the first electronic switch;

a fifth conducting pad coupled to the control end of the second electronic switch;

a first diode coupled to the control end of the second electronic switch;

a sixth conducting pad coupled to the control end of the second electronic switch through the first diode;

a second diode coupled between the control end of the first electronic switch and the sixth conducting pad; and a slide switch, comprising:

a slide button; and a contact;

wherein when the slide button moves to a first position, the contact is accordingly moved for coupling the first conducting pad and the fourth conducting pad; when the slide button moves to a second position, the contact is accordingly moved for coupling the second conducting pad and the fifth conducting pad; when the slide button moves to a third position, the contact is accordingly moved for coupling the third conducting pad and the sixth conducting pad.

* * * * *